US008522688B2

(12) United States Patent
Pritzl

(10) Patent No.: US 8,522,688 B2
(45) Date of Patent: Sep. 3, 2013

(54) RAIL ANCHOR SPREADER-SQUEEZER

(75) Inventor: Patrick Pritzl, Franksville, WI (US)

(73) Assignee: Nordco Inc., Oak Creek, WI (US)

( * ) Notice: Subject to any disclaimer, the term of this patent is extended or adjusted under 35 U.S.C. 154(b) by 400 days.

(21) Appl. No.: 12/817,494

(22) Filed: Jun. 17, 2010

(65) Prior Publication Data

US 2011/0308421 A1 Dec. 22, 2011

(51) Int. Cl.
*E01B 29/24* (2006.01)

(52) U.S. Cl.
USPC ..... 104/17.2

(58) Field of Classification Search
USPC ..... 104/2, 5, 16, 17.1, 17.2
See application file for complete search history.

(56) References Cited

U.S. PATENT DOCUMENTS

| | | | | |
|---|---|---|---|---|
| 4,457,060 | A | 7/1984 | Parks et al. | |
| 4,890,558 | A | 1/1990 | Quella et al. | |
| 4,903,611 | A | 2/1990 | Holley | |
| 5,074,219 | A | 12/1991 | Theurer et al. | |
| 5,117,760 | A | 6/1992 | Almaraz et al. | |
| 5,277,122 | A | 1/1994 | Almaraz et al. | |
| 5,331,899 | A | 7/1994 | Holley | |
| 5,438,931 | A | 8/1995 | Becker et al. | |
| 5,586,502 | A * | 12/1996 | Weber | 104/17.2 |
| 5,694,856 | A * | 12/1997 | Theurer | 104/17.2 |
| 5,915,744 | A | 6/1999 | Cotsford | |
| 6,138,573 | A * | 10/2000 | Brenny et al. | 104/17.2 |
| 6,662,729 | B1 * | 12/2003 | Madison | 104/17.2 |
| 7,574,961 | B2 * | 8/2009 | Barezzani et al. | 104/17.2 |

FOREIGN PATENT DOCUMENTS

| | | |
|---|---|---|
| CA | 2047647 | 2/1992 |
| CA | 2187613 | 4/1997 |

* cited by examiner

*Primary Examiner* — R. J. McCarry, Jr.
(74) *Attorney, Agent, or Firm* — Greer, Burns & Crain, Ltd.

(57) ABSTRACT

A rail maintenance anchor spreader/squeezer work head includes a work head frame, a pair of sliding brackets laterally reciprocating on the frame, each bracket having an anchor engaging end, and a pair of opposed fluid power cylinders secured to the frame, each cylinder connected to a respective one of the sliding brackets for laterally reciprocating the sliding brackets for any one of anchor squeezing, when both cylinders are extended, and anchor spreading when at least one of the cylinders is retracted.

21 Claims, 23 Drawing Sheets

RAIL ANCHOR SPREADER-SQUEEZER

BACKGROUND

The present invention relates to rail maintenance equipment, and specifically to maintenance equipment for spreading and squeezing anchor position with respect to the tie.

A rail anchor clamps onto a rail and is typically applied in pairs, one on each side of a rail tie to resist longitudinal movement of the rail relative to the supporting tie. In the course of rail maintenance, wooden ties are often replaced by pulling them transversely from beneath the rails. A part of this operation is the mechanical spreading of the anchors laterally away from edges of the tie to facilitate old tie removal and the insertion of new tie. An example of a conventional anchor spreader is U.S. Pat. No. 5,117,760. In some cases, through use, the anchors become embedded in the sides of the tie, and are difficult to remove. Existing anchor removers such as the model disclosed in the '760 patent have been known to have difficulty in removing such embedded anchors.

Upon replacement of the tie, the previously spread anchors are mechanically squeezed into place to secure the new tie. Typically, railroads employ distinct, single task-oriented machines in this process, one restricted to anchor spreading, and the other to anchor squeezing. Thus, according to conventional railroad right of way maintenance procedures, the railroads have to change machines when the anchors are to be repositioned after tie replacement.

One conventional type of a task-specific anchor squeezing machine is disclosed in U.S. Pat. No. 5,277,122. This device employs a pivoting actuator for positioning the anchors. In practice, this device has been known to cause misalignment of the anchors on the rail, to the extent that the anchors disengage from the rail as trains pass over them.

Another factor in designing rail maintenance equipment for spreading and squeezing anchors is that the width of railroad track rails changes across the US due to manufacturing differences. Thus, a typical rail anchor spreader or squeezer must often be adapted or modified to accommodate these variations so that proper operation is maintained.

SUMMARY

The above-identified drawbacks of prior art anchor spreaders and squeezers are addressed by the present rail maintenance machine having an anchor spreader/squeezer work head. One feature of the present work head is that it has the capability for both squeezing anchors and spreading them, the conversion being achieved by an alternate function on the control system, which changes the sequence in laterally moving sliding brackets. Also, task-specific tools are interchangeably mounted to free ends of the sliding brackets.

Another feature of the present work head is that the same sliding brackets can spread the anchors by direct contact, and alternatively by grasping the rail tie plate located between the rail base and the upper surface of the tie, may employ the tie plate as a hammer reciprocating in the direction of the rail for facilitating the dislodging of anchors from the sides of the tie.

Still another feature of the present work head is that it is provided with an anchor-engaging tool configured for accommodating variations in rail base widths. Thus, anchor spreading or squeezing work in the field need not be interrupted by the installation of various anchor-engagement tools tailored for specific rail base widths.

More specifically, a rail maintenance anchor spreader/squeezer work head is provided and includes a work head frame, a pair of sliding brackets laterally reciprocating on the frame, each bracket having an anchor engaging end, and a pair of opposed fluid power cylinders secured to the frame, each cylinder connected to a respective one of the sliding brackets for laterally reciprocating the sliding brackets for one of anchor squeezing, when both cylinders are extended, and anchor spreading when at least one of the cylinders is retracted.

In another embodiment, a rail anchor spreader/squeezer machine is provided and is configured for selectively squeezing or spreading anchors on a rail of a railroad track. The machine includes a machine frame having a front frame end and a rear frame end. At least one work head is mounted to the frame and is reciprocably movable relative to the track between a working position and a travel position. A control system connected to the work head, and the work head is capable of performing anchor spreading and anchor squeezing depending on an operational sequence determined by the control system.

In still another embodiment, a tool is provided for use with a rail maintenance anchor spreader/squeezer having at least one sliding bracket with a work arm having an anchor engaging end. A tool body has a mounting end and an opposite anchor work end, the anchor work end including at least one impact surface. The tool body is provided with a rail following surface extending transverse to the mounting end and to the work end, and parallel to a corresponding rail of a railroad track. In addition, the following surface is stepped for accommodating variations in rail base width.

DETAILED DESCRIPTION

Figure 1:
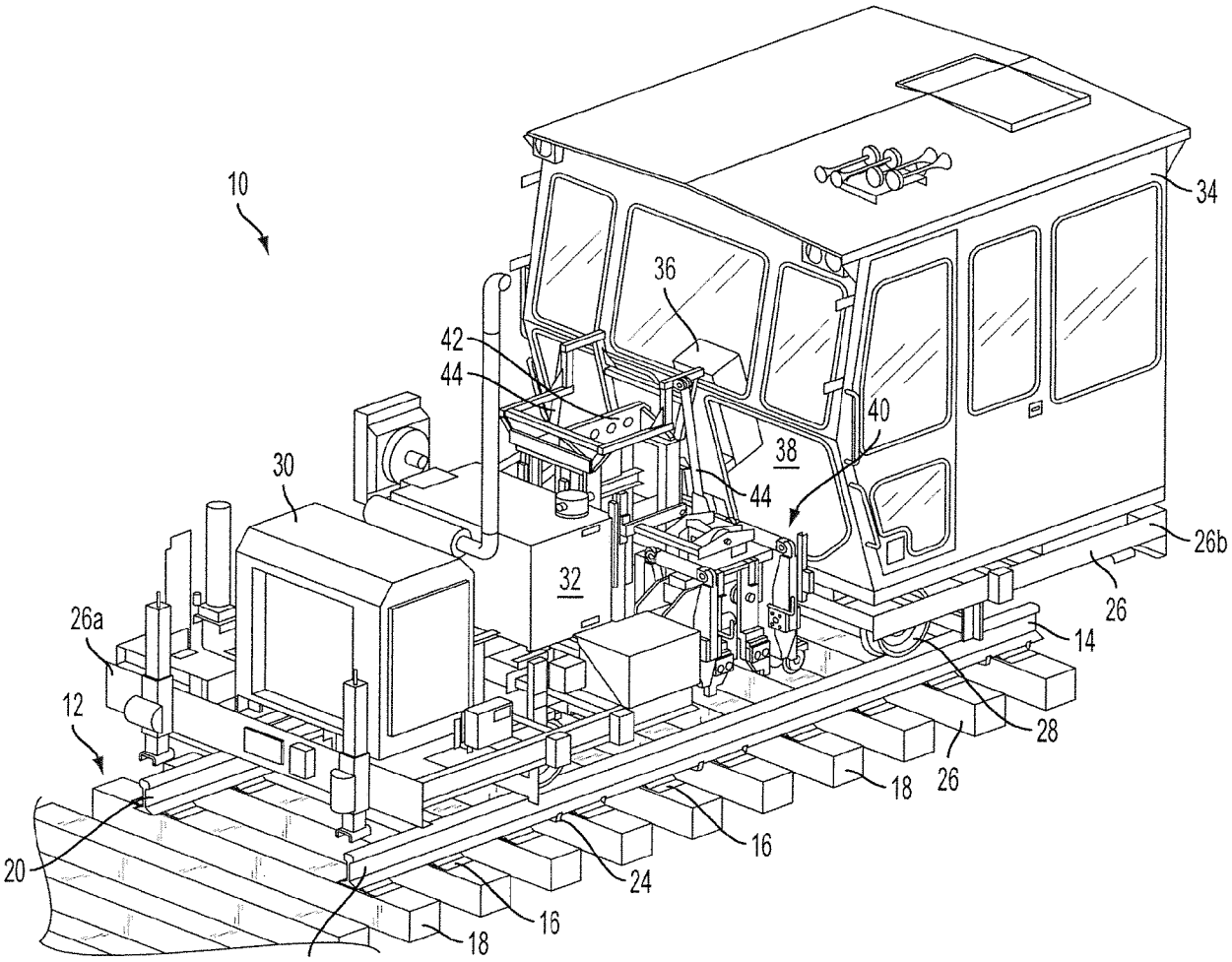
FIG. 1 is a top perspective view of a rail maintenance machine equipped with the present anchor spreader/squeezer work head.
Figure 2:
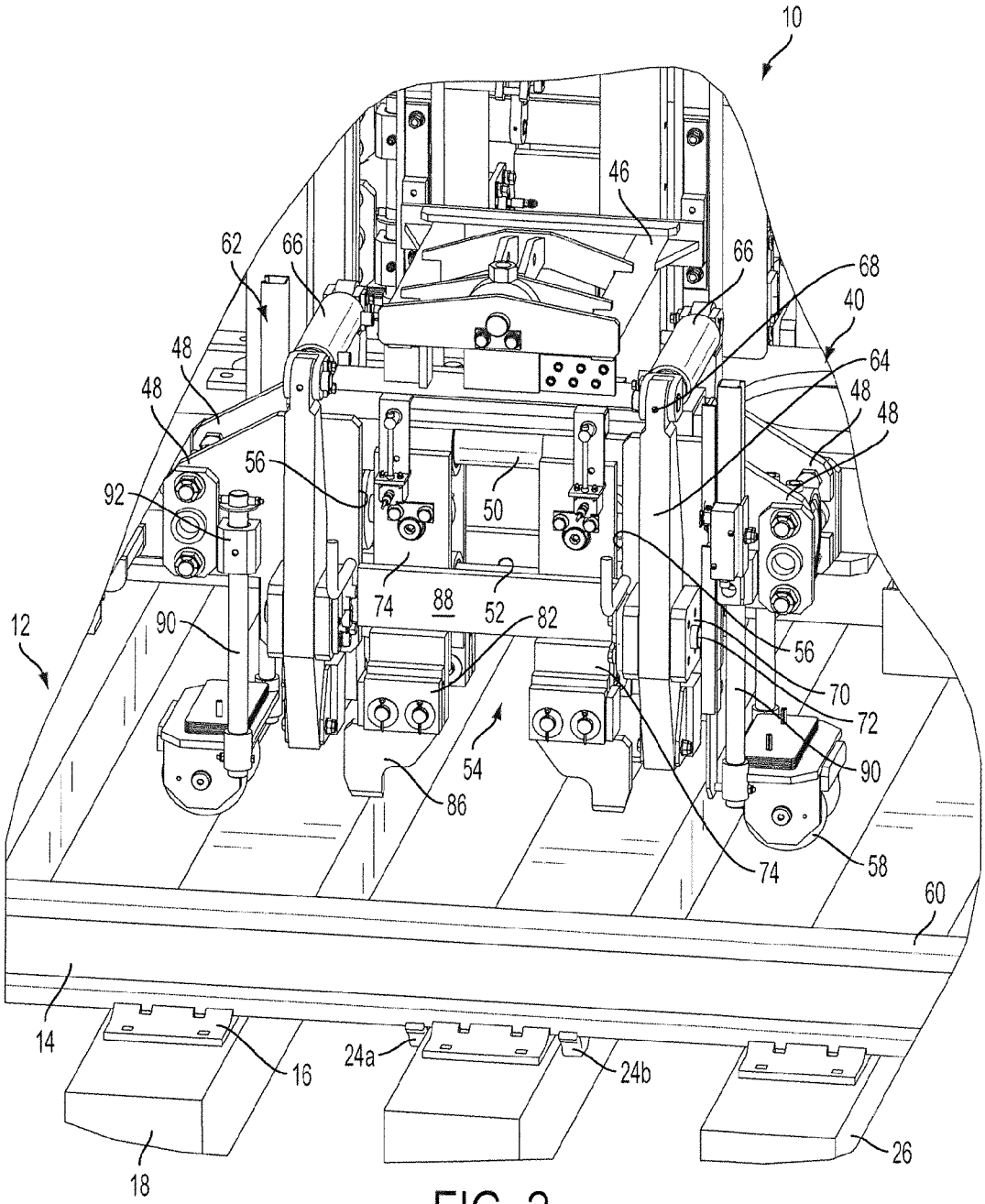
FIG. 2 is a fragmentary top perspective view of the machine of FIG. 1 depicting the present anchor spreader/squeezer work head in a travel position.

Referring to FIGS. 1 and 2, a rail maintenance machine suitable for use with the present anchor spreader/squeezer work head is generally designated 10. As is known in the art, the machine 10 is designed for use in maintaining a railroad track 12, including a pair of spaced rails 14 resting on tie plates 16 located upon transversely arranged ties 18. The ties 18 are typically made of wood or concrete, and when wooden, they require periodic replacement. The rails 14 and the tie plates 16 are secured to the ties 18 by spikes or other fasteners (not shown) as is well known in the art. A space between the rails is referred to as the gage area, and the space external to the rails is referred to as the field area, so each rail 14 has a gage side 20 and a field side 22 (FIG. 1).

It is common for a track 12 to be provided with pairs of anchors 24 located on sides 26 of selected rail ties 18. Anchors 24 (Best seen in FIG. 20) are generally crescent-shaped clips of steel which are configured to frictionally grasp the rail adjacent the tie. When provided on either side of the tie 18, the anchors 24 prevent linear misalignment or racking of the track 12 during use. During rail maintenance, it is typical to periodically replace the rail ties 18. In order to replace the tie, the fasteners (typically spikes) are first removed, and then the anchors are either removed or spread apart to create a clearance for the tie 18, which is removed transversely relative to the track. A suitable tie removing machine is disclosed in U.S. Pat. No. 6,463,858 which is incorporated by reference.

Included on the machine 10 is a frame 26 having wheels 28 suitable for travel on the rails 14. An engine 30 powers the wheels 28 through a hydraulic system 32, including a fluid reservoir, pump, manifold and valves as is known in the art. The engine 30 also provides power for other functions of the machine 10. An operator's cab 34 is mounted to the frame 26 and includes a control system 36, an operator's station (not shown), as well as windows 38 through which the operator can view the track 12 being worked on.

Also visible through the windows 38 is at least one and preferably a pair of anchor spreader/squeezer work heads 40, suspended from a vertically projecting, central truss 42 of the machine frame 26. Each work head 40 is movable relative to the truss 42 between a travel position, spaced away from the rails 14, and a working position, spaced relatively closer to the rails, by actuation of a fluid power lift cylinder 44. In the present application, "fluid power" refers to hydraulic or pneumatic cylinders, but hydraulic cylinders are preferred. It will be appreciated that the machine 10 preferably is equipped with a pair of work heads 40, one associated with each of the rails 14, however only one such work head will be discussed. It will be appreciated that on the machine 10, both work heads 40 operate in the same direction at the same time as described below.

An important feature of the present work head 40 is that the same unit can perform multiple anchor-related functions. Specifically, the work head 40 can both squeeze anchors together and spread anchors apart, depending on commands provided by the control system 36. In addition to these functions, as an option the work head 40 is also configured so that a selected rail tie plate 16 is grasped and used as a hammer reciprocating along the rails 14 for sequentially impacting each of a selected pair of the anchors 24.

Referring now to FIG. 2, a work head frame 46 is slidably coupled to the central truss 42 and is selectively moved relative to the truss by the lift cylinder 44. Included on the work head frame 46 is a pair of spaced, parallel main plates 48 generally aligned with the rail. Oriented between the main plates 48 are upper and lower guide shafts, 50 and 52. The shafts 50, 52 are located in a work zone 54 generally defined between inner edges 56 of the plates 48 and extending towards the track 12.

Each work head 40 has at least one and preferably a pair of guide wheels 58 connected to the main plates 48 for maintaining alignment of the work head relative to the rail 14. As is known in the art, the guide wheels 58 preferably have a concave periphery for facilitating engagement with a head 60 of the rail 14. Inboard of the guide wheels 58 and closer to the work zone 54 is at least one and preferably a pair of rail clamps 62. While a variety of rail clamp mechanisms are contemplated, in the preferred embodiment, each rail clamp includes a pair of pivoting pincer arms 64 connected by fluid power clamp cylinders 66 transversely mounted relative to the rail 14 between upper ends 68 of the arms. Each pincer arm 64 is connected to the work head frame 46 at a pivot bracket 70 including a pivot pin 72 generally parallel to the rail 14. Operation of the clamp cylinders 66 is controlled by the control system 36. In general, extension of the cylinders 66 spreads the upper ends 68 of the arms 64, creating a clamping force. Similarly, retraction of the cylinders 66 brings together the upper ends 68 of the arms 64, releasing the clamping force on the rail 14.

Referring now to FIGS. 2-5), the work zone 54 is at least one and preferably a pair of sliding brackets 74 laterally reciprocating on the upper and lower guide shafts 50, 52. The operation of the brackets 74 is along an operational axis which is parallel to a longitudinal rail axis defined by the rails 14. While other constructions are contemplated, each sliding bracket 74 includes a pair of spaced, parallel work arms 76 separated by a bushing 78 (FIG. 4) slidably engaging the respective guide shafts 50, 52. The work arms 76 are respectively associated with the field side 22 and the gage side 20 of the rail 14. Each bracket 74 is connected to a corresponding fluid power (preferably hydraulic) cylinder 80 disposed between the main plates 48 of the work head frame 46 and oriented to be parallel to the rails 14 and in opposing relationship to each other. In other words, ends of corresponding rods of the cylinders 80 are preferably disposed to face each other. However, it is also contemplated that in some applications the disposition of the cylinders 80 is reversed, with the cylinder bodies facing each other. Also, in the preferred embodiment, the cylinders 80 are disposed between and generally parallel to the guide shafts 50, 52.

Rods of the cylinders 80 are preferably connected to the work arms 76 so that retraction or extension of the rods via selective pressurization of the cylinders 80 will cause movement of the brackets 74 along the guide shafts 50, 52 in the work zone 54. In the preferred embodiment, the cylinders 80 are double acting, however, it is also contemplated that single acting, spring-return cylinders are also suitable.

Thus, it will be seen that the opposed cylinders 80, controlled by the control system 36, are each connected to a respective one of the sliding brackets 74 for laterally reciprocating the sliding brackets for any one of anchor squeezing, when both of the cylinders 80 are extended (referring to the rod action), and anchor spreading, when at least one of the cylinders is retracted. It is contemplated that the above-described configuration of the work head frame 46 may vary to suit the application as long as the functional operations of anchor squeezing and spreading by the sliding brackets 74 are achieved.

Figure 17:
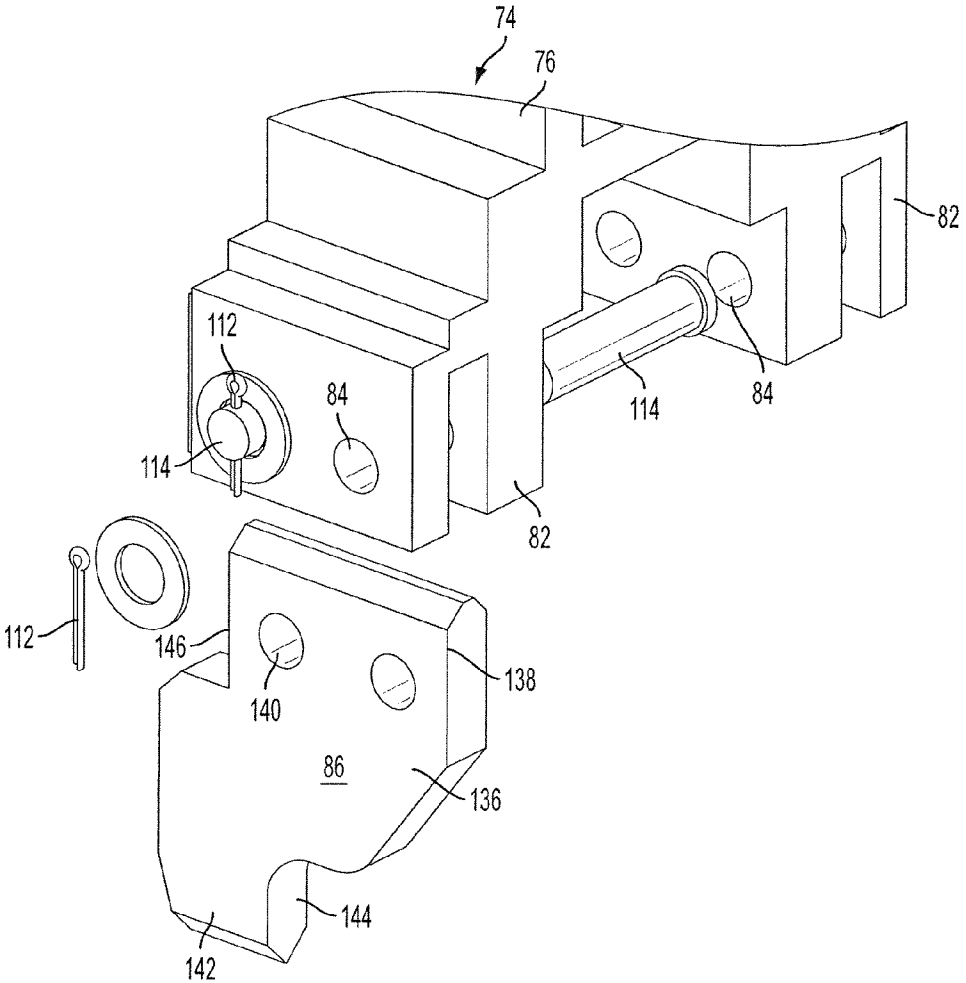
FIG. 17 is a fragmentary top perspective exploded view of a lower end of the present work head depicted with the tool of FIG. 2.
Figure 18:
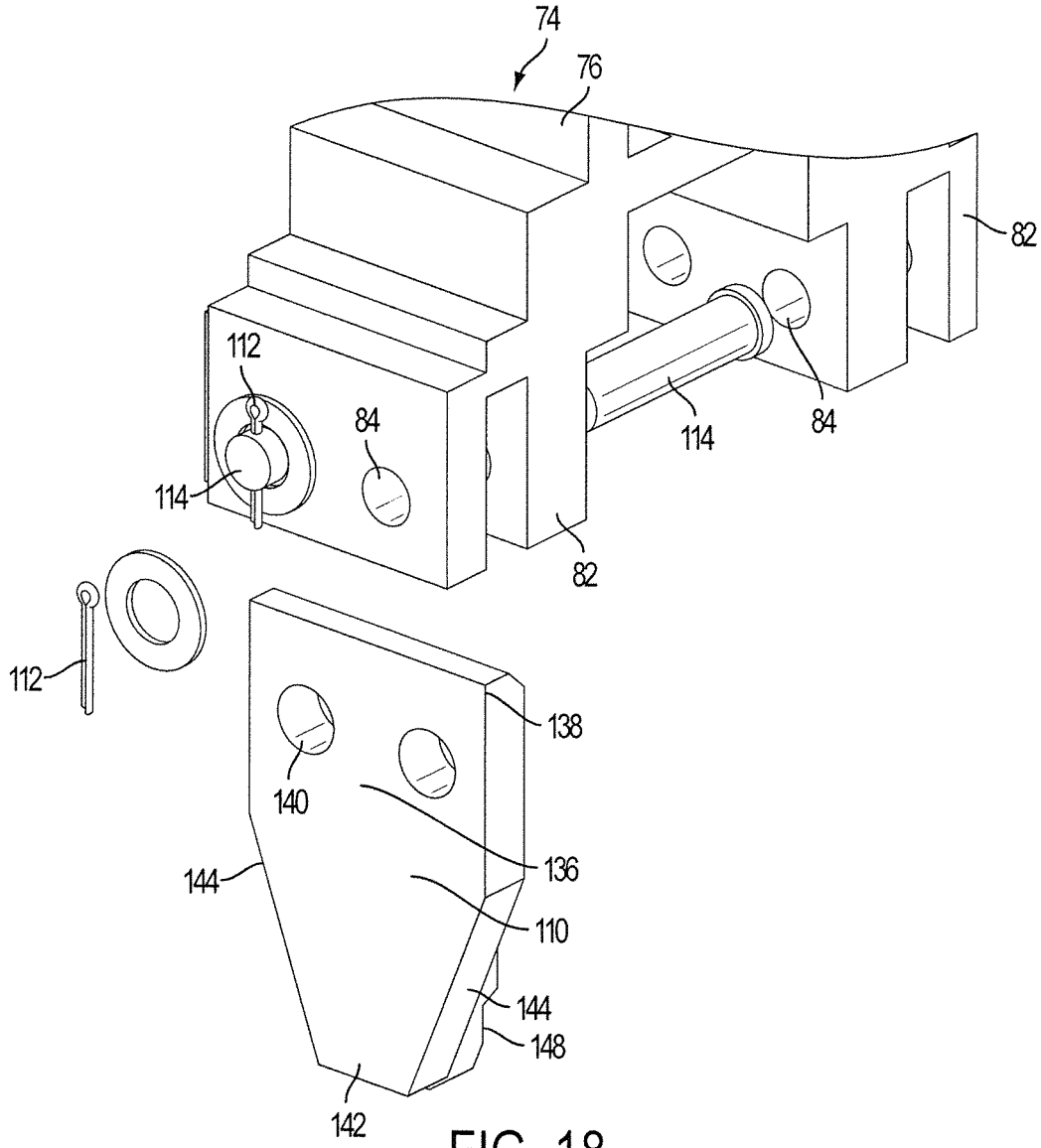
FIG. 18 is a fragmentary top perspective exploded view of a lower end of the present work head depicted with the tool of FIG. 8.
Figure 19:
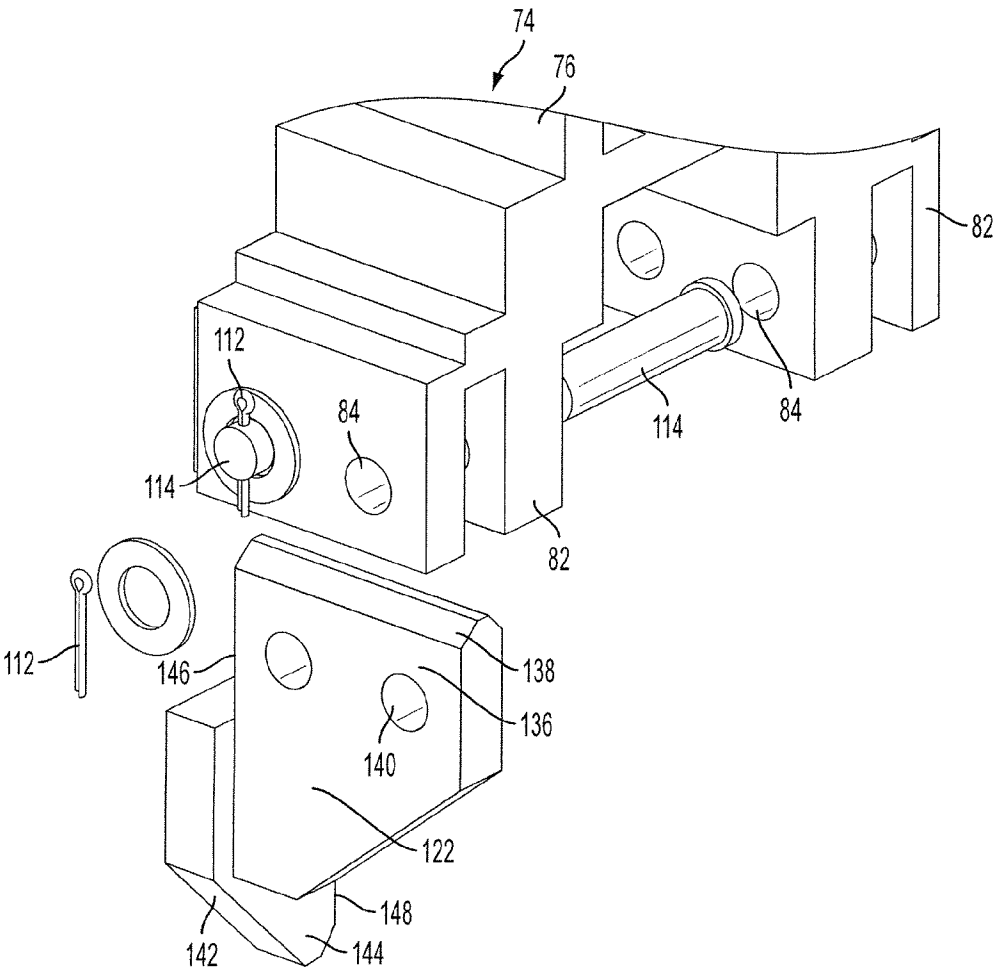
FIG. 19 is a fragmentary top perspective exploded view of a lower end of the present work head depicted with the tool of FIG. 12.

Referring now to FIGS. 17-19, in addition, each bracket 74 has an anchor engaging end 82 provided with at least one and preferably a pair of mounting bores 84 for selective attachment of one of a selected type of anchor tools 86, to be described in greater detail below. It will be seen that each work arm 76 of each sliding bracket 74 has a corresponding anchor tool 86. Structural support for the work head frame 46 in the work zone 54 is provided by a pair of support bars 88 secured at corresponding ends to the main plates 48.

Referring now to FIGS. 2-7, the work head 40 will be described in greater detail in the context of the optional anchor spreading operation where the tie plate 16 is used as a reciprocating hammer for spreading the anchors 24. Initially, in FIG. 2, the work head 40 is raised above the rail 14 in the travel position through action of the lift cylinder 44. It will be seen that in this position, the guide wheels 58 are not in contact with the rail 14, and suspension rods 90 for the guide wheels are extended relative to mounting blocks 92 which slidably receive the suspension rods 90. As with all of the cylinders in the present machine 10, the lift 44 is under the control of the control system 36.

Figure 3:
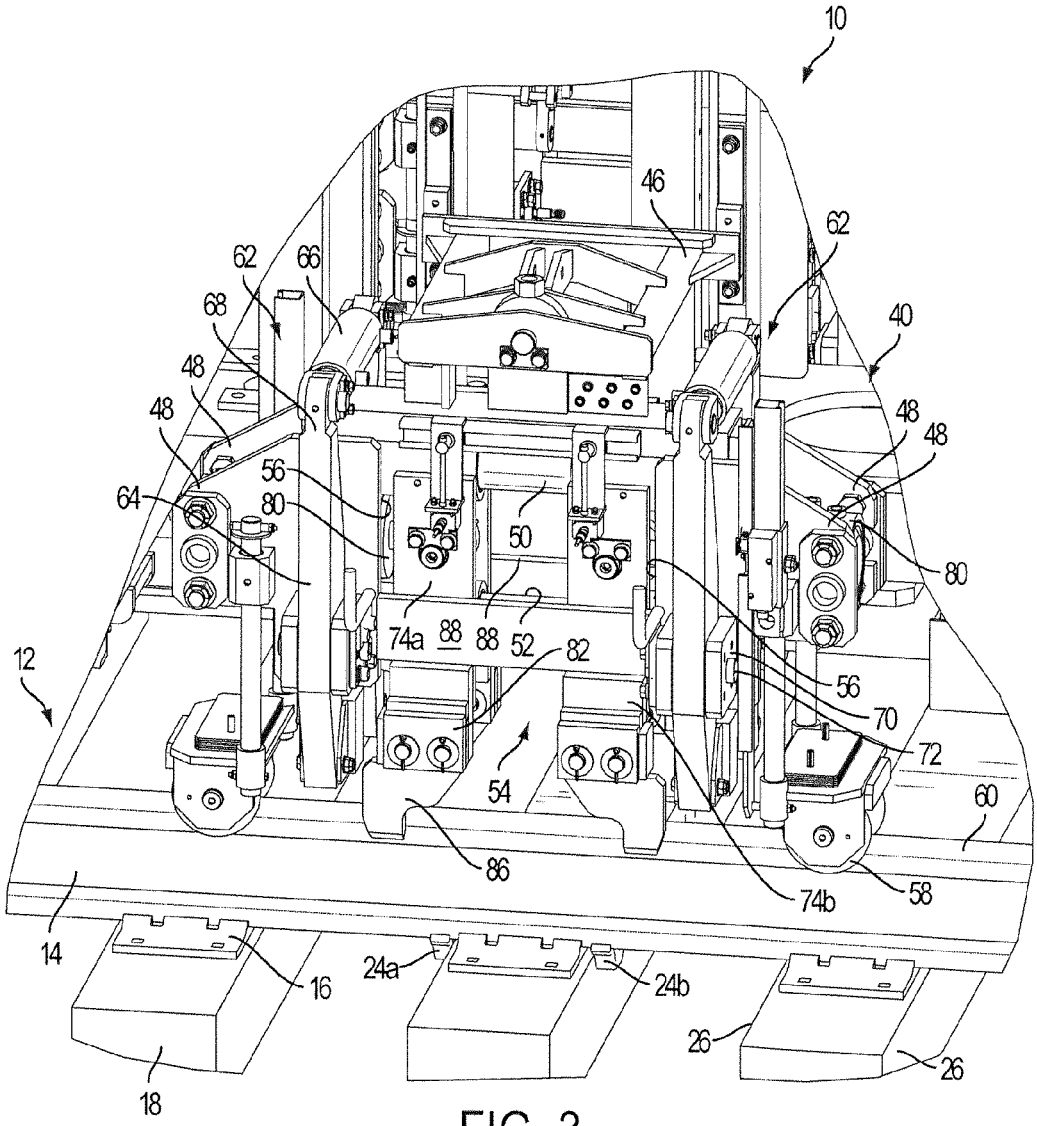
FIG. 3 is a fragmentary top perspective view of the machine of FIG. 1 depicting the work head in a ready or working position.

Referring now to FIG. 3, the lift 44 has lowered the work head 40 to the ready or working position, in which the guide wheels 58 are in contact with the rail head 60 and the anchor tools 86 are aligned with the rail head. At this point, both of the cylinders 80 are retracted, so that the sliding brackets 74 are spaced apart from each other, and are adjacent inner margins of the main plates 48. Note that in this rail maintenance operation, the spikes or other fasteners have been removed from the ties 18 to be removed.

Since the cylinders 80 are identical to each other, but each operates a respective sliding bracket 74, they will now be referred to as a front cylinder 80*a* associated with a front of the machine 10 and farther from the operator's cab 34, and a rear cylinder 80*b*, associated with a rear of the machine and closer to the operator's cab. The corresponding sliding brackets 74, as well as the anchors 24 being squeezed or spread, and the front and rear ends of the machine frame 26 will also be designated "a" and "b." Further, the following operational discussion can be reviewed in flow chart logic sequence in relation to FIG. 21.

Figure 4:
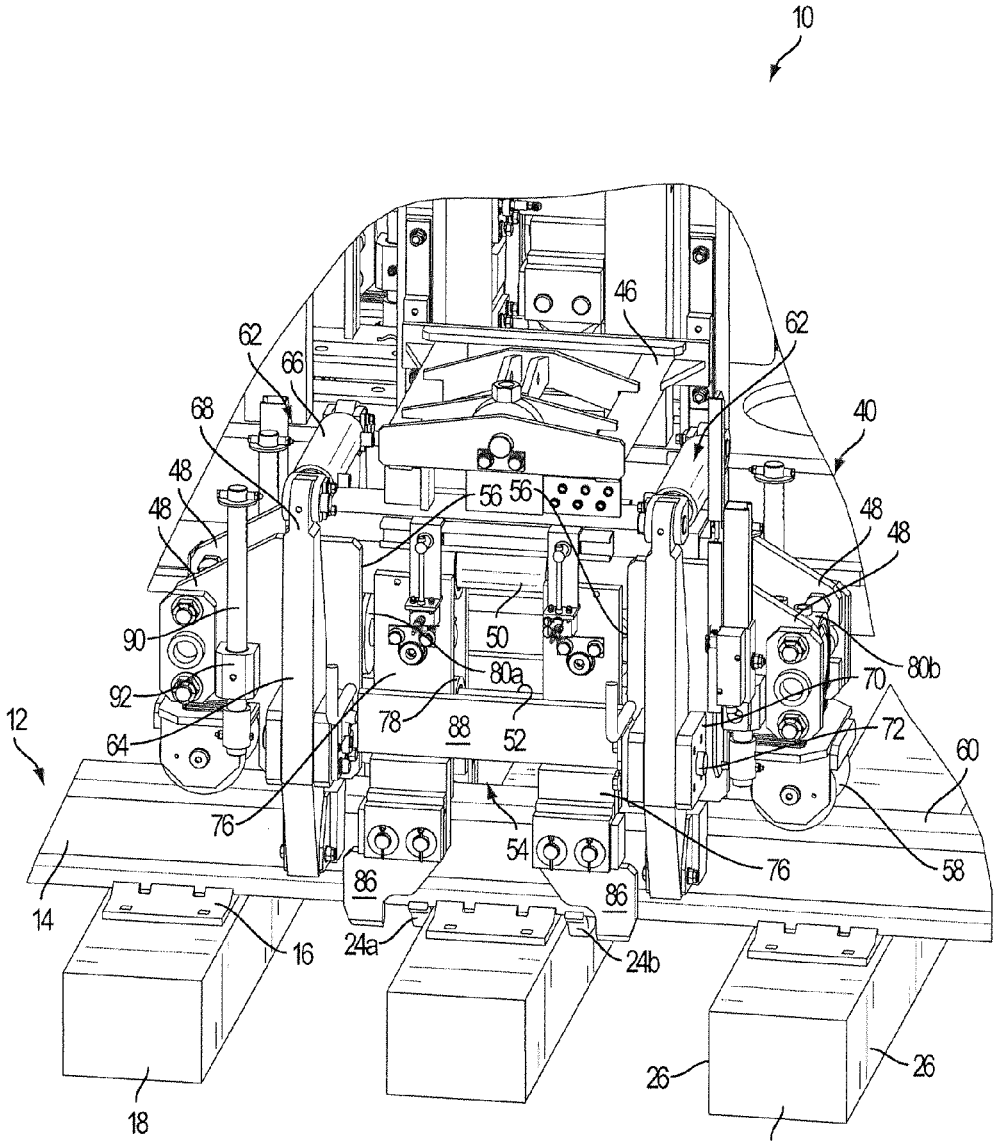
FIG. 4 is a fragmentary top perspective view of the machine of FIG. 1 depicting the work head in a tie plate engaging position.
Figure 5:
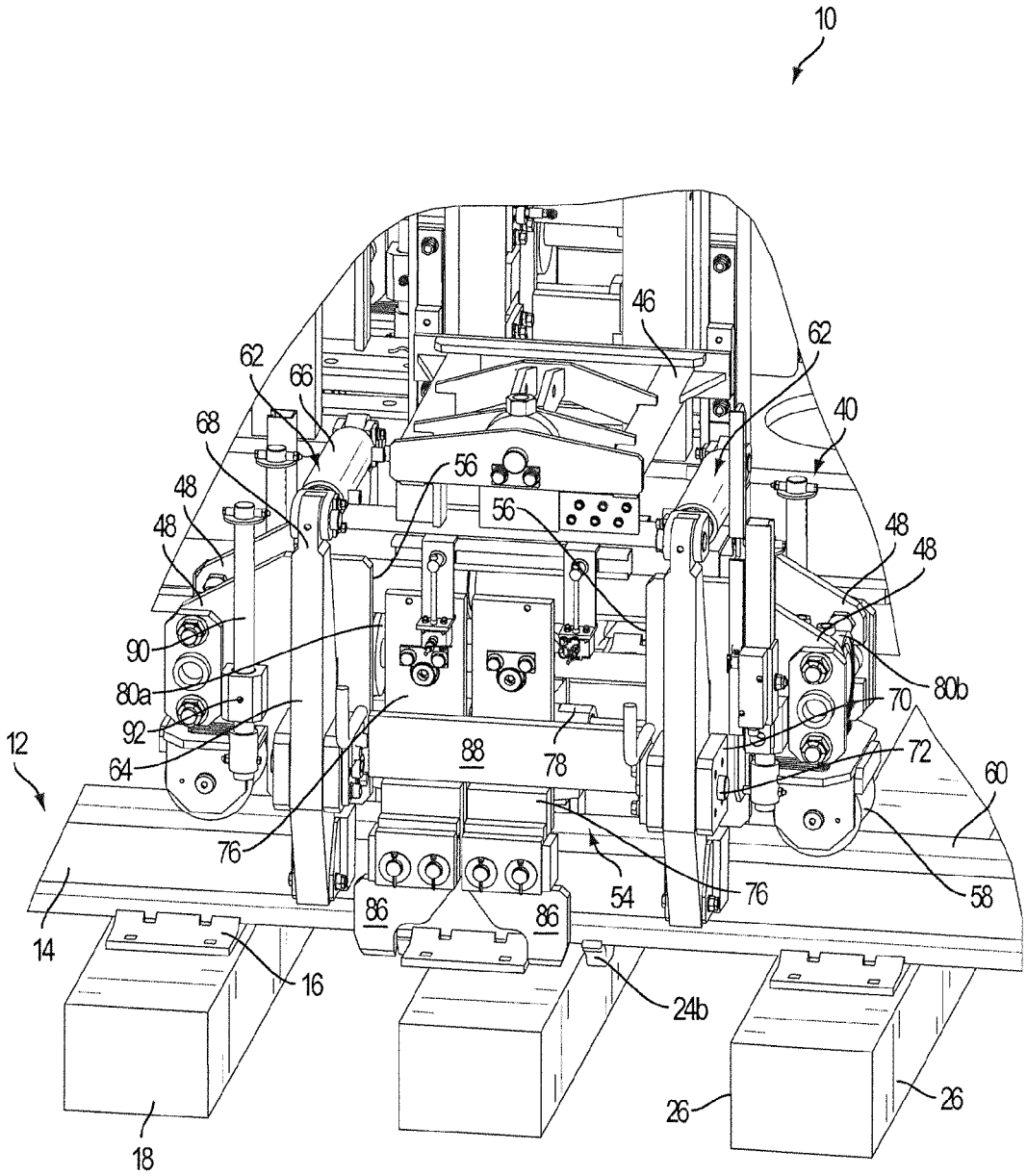
FIG. 5 is a fragmentary top perspective view of the machine of FIG. 1 depicting the work head using the tie plate to spread a first or forward anchor.

Referring now to FIG. 4, the lift cylinder 44 extends further, lowering the work head 40 so that the anchor tools 86 are adjacent the anchors 24 and the tie plate 16. This is known as the ready or working position, as indicated in box 94 of FIG. 21. At this time, the rail clamp cylinders 66 extend, so that the work head 40 is clampingly engaged upon the rail 14, as seen in box 96 of FIG. 21. Next, as seen in FIG. 5 and in box 98 of FIG. 21, the control system 36 causes the rear cylinder 80*b* to extend, pushing the corresponding sliding bracket 74*b* towards the front bracket, in so doing engaging and pushing the tie plate 16 towards the front bracket, spreading the front anchor 24*a* and clamping the tie plate 16 between the anchor tools 86. During this motion, the front cylinder 80*a* is held in place.

Figure 6:
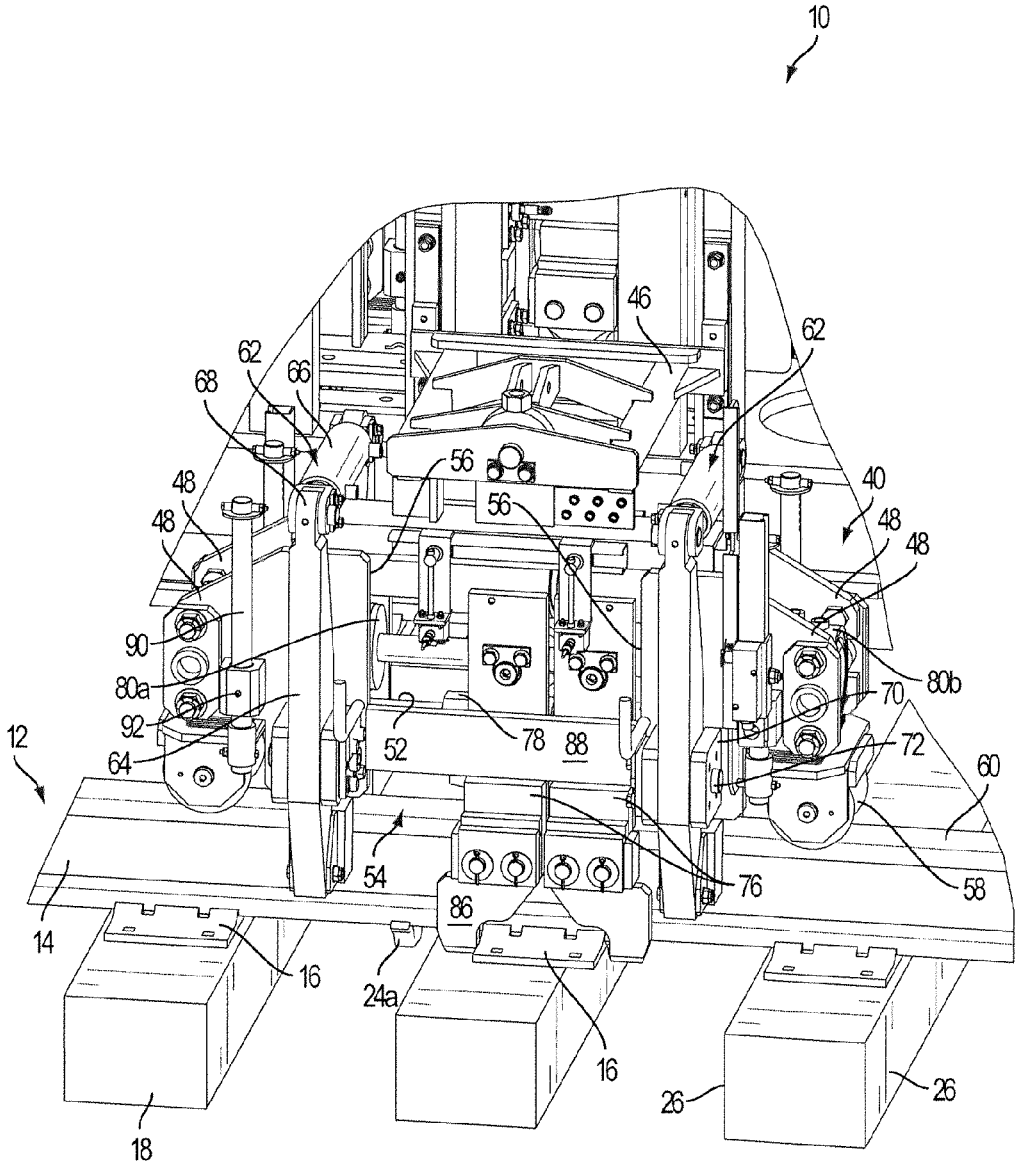
FIG. 6 is a fragmentary top perspective view of the machine of FIG. 1 depicting the work head using the tie plate to spread a second or rearward anchor.
Figure 21:
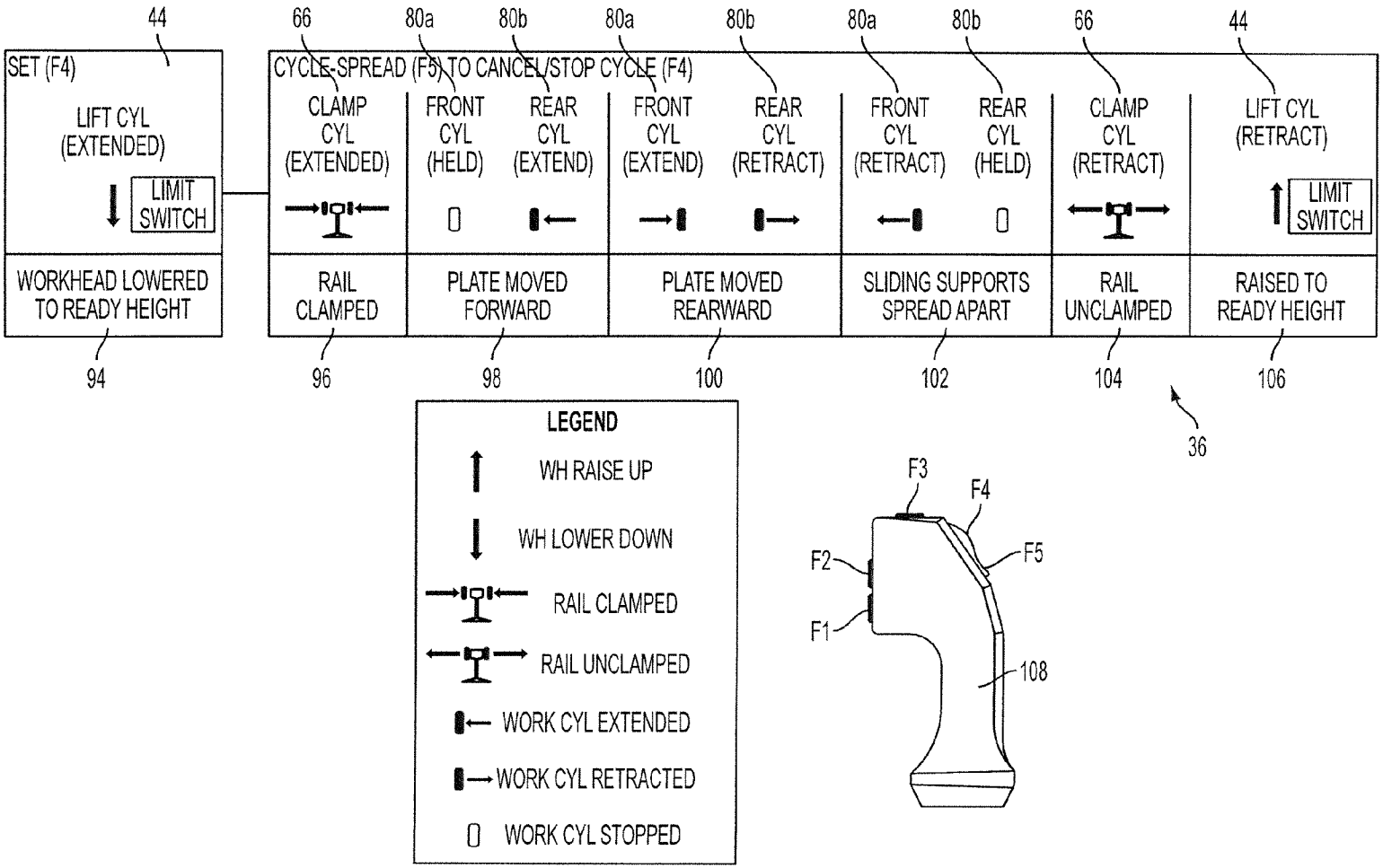
FIG. 21 is a control system flow chart supporting the operation depicted in FIGS. 2-7.

Next, referring to FIG. 6, and box 100 of FIG. 21, the front cylinder 80*a* extends simultaneously with retraction of the rear cylinder 80*b*, causing the grasped tie plate 16 to move rearwardly. In other words, the cylinders 80*a*, 80*b* complementarily extend and retract to move the tie plate 16 to spread the second anchor 24*b* in an opposite direction from the first anchor 24*a*. In this motion, the tie plate 16 engages and spreads the rear anchor 24*b* away from the tie 18. Upon completion of this operation, the anchors 24*a*, 24*b* are sufficiently spread to accommodate removal of the tie 18. As seen in box 102 of FIG. 21, the front cylinder 80*a* retracts, and the rear cylinder 80*b* is held in place so that the anchor tools 86 are spread apart to release the tie plate 16.

Figure 7:
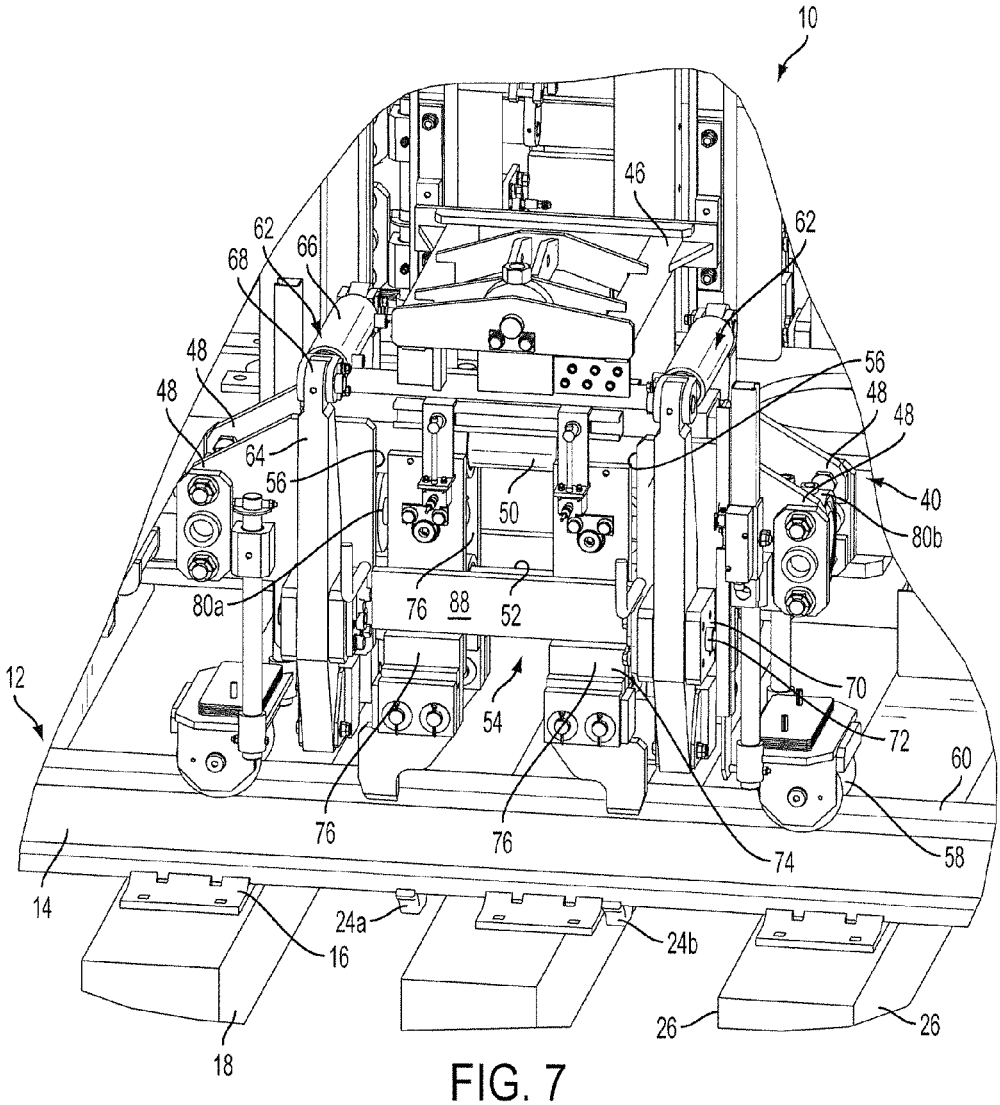
FIG. 7 is a fragmentary top perspective view of the machine of FIG. 1 depicting the work head in a ready position after two anchors have been spread.

Preferably simultaneously, the rail clamp cylinders 66 retract (box 104) releasing the rail clamps 62 and the lift cylinder 44 retracts (box 106) to pull the work head 40 upward (FIG. 7). As seen in FIG. 21, the control system 36 is configured so that actuation of a single button F4 on a joystick 108 initiates the complete automatic sequence depicted in boxes 94-106.

Referring now to FIGS. 8-11 and 22, an embodiment is depicted in which the machine 10 is configured for anchor spreading without using the tie plate 16. Instead, specialized anchor tools 110 are provided, being generally wedge shaped or downwardly tapered, while still being mounted to the common mounting bores 84 at the anchor engaging end 82 of the work arms 76. It is anticipated that the anchor tools 86, 110 may be readily interchanged by the operator or in a railroad maintenance shop, as by removing fasteners such as cotter pins 112 retaining mounting pins 114 holding the tool in place in the bores 84.

Figure 8:
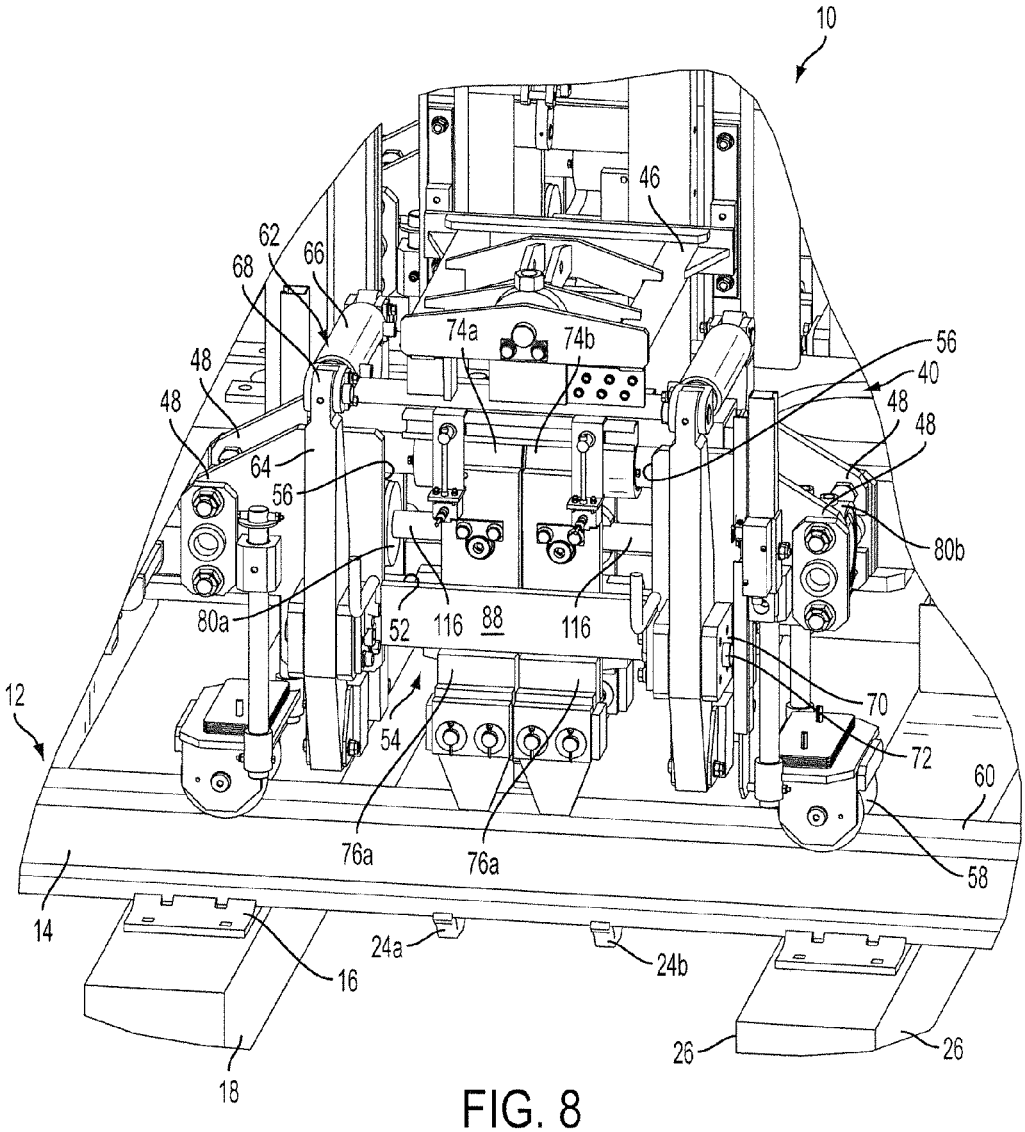
FIG. 8 is a fragmentary top perspective view of the machine of FIG. 1 depicting the work head fitted with tools for direct contact anchor spreading and shown in a ready position.

In describing the operation of this embodiment, steps which are identical to those described in relation to FIGS. 2-7 and 21 will be designated with the same reference numbers. Referring first to FIG. 8, the work head 40 is lowered by the lift cylinder 44 so that the guide wheels 58 contact the rail head 60. Note that both of the cylinders 80*a*, 80*b* are in the extended position, so that the sliding brackets 74 are in contact with each other in the middle of the work zone 54. In this view, cylinder rods 116 are visible.

Figure 9:
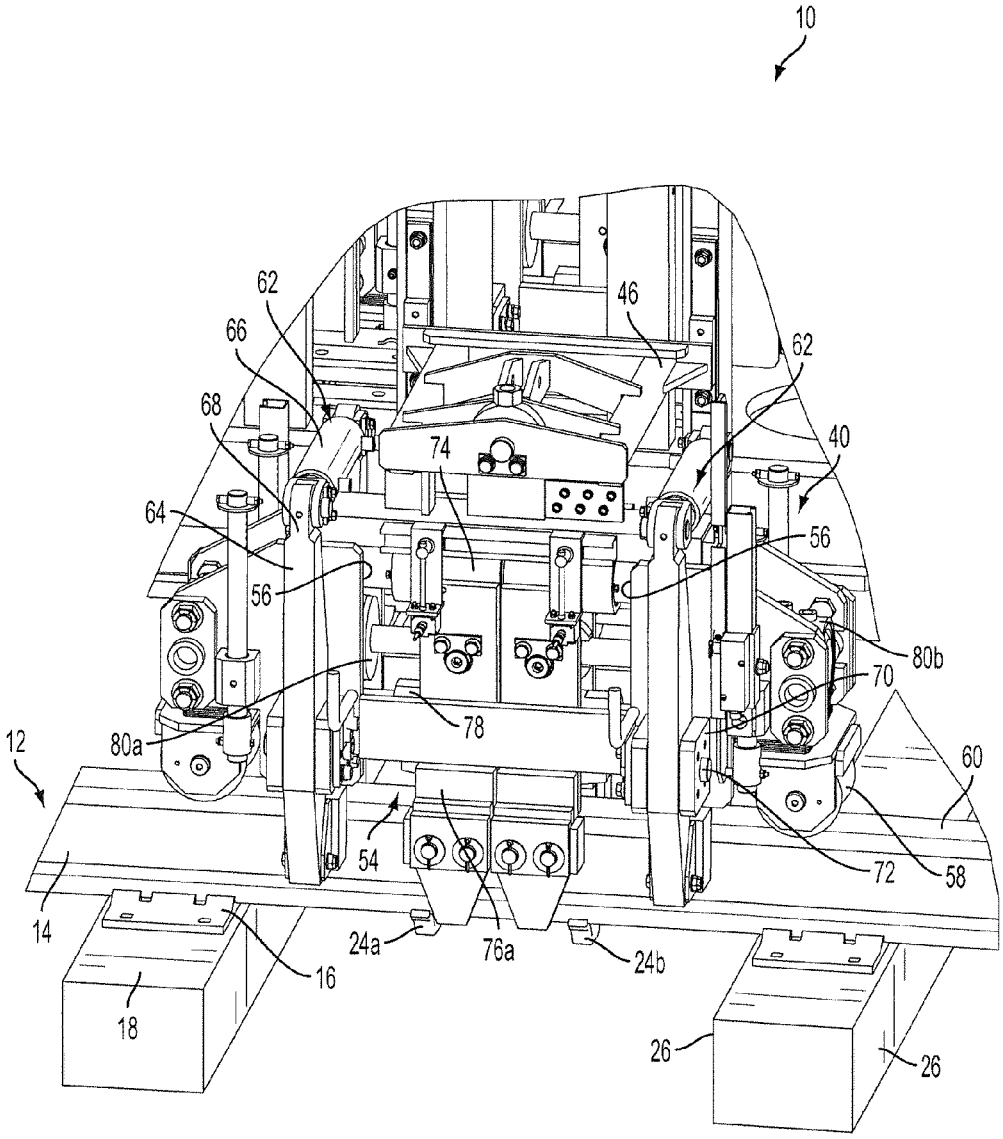
FIG. 9 is a fragmentary top perspective view of the machine of FIG. 1 depicting the work head of FIG. 8 in an anchor engaging position.
Figure 10:
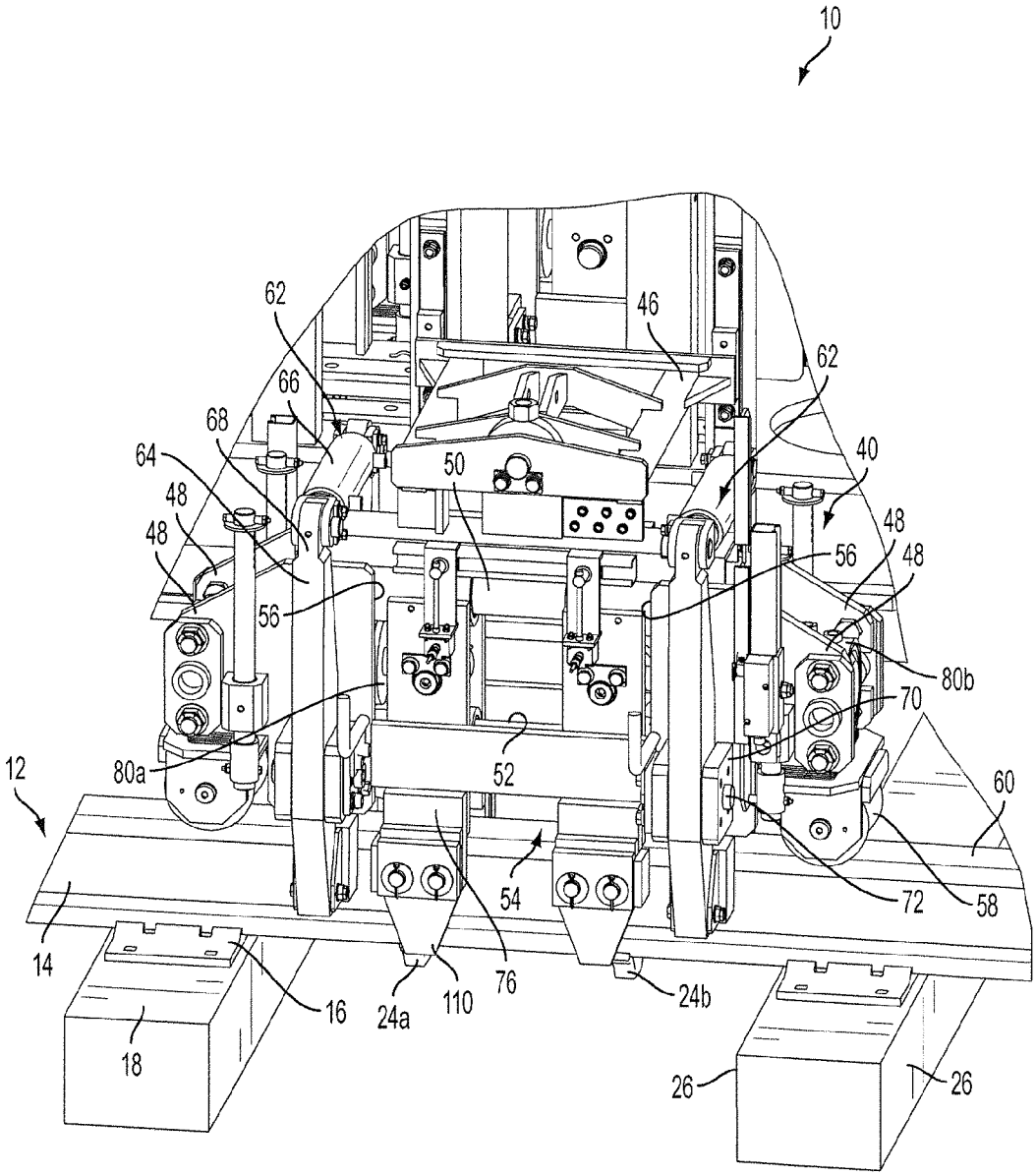
FIG. 10 is a fragmentary top perspective view of the machine of FIG. 1 depicting the work head of FIG. 8 in an anchor spreading position.
Figure 11:
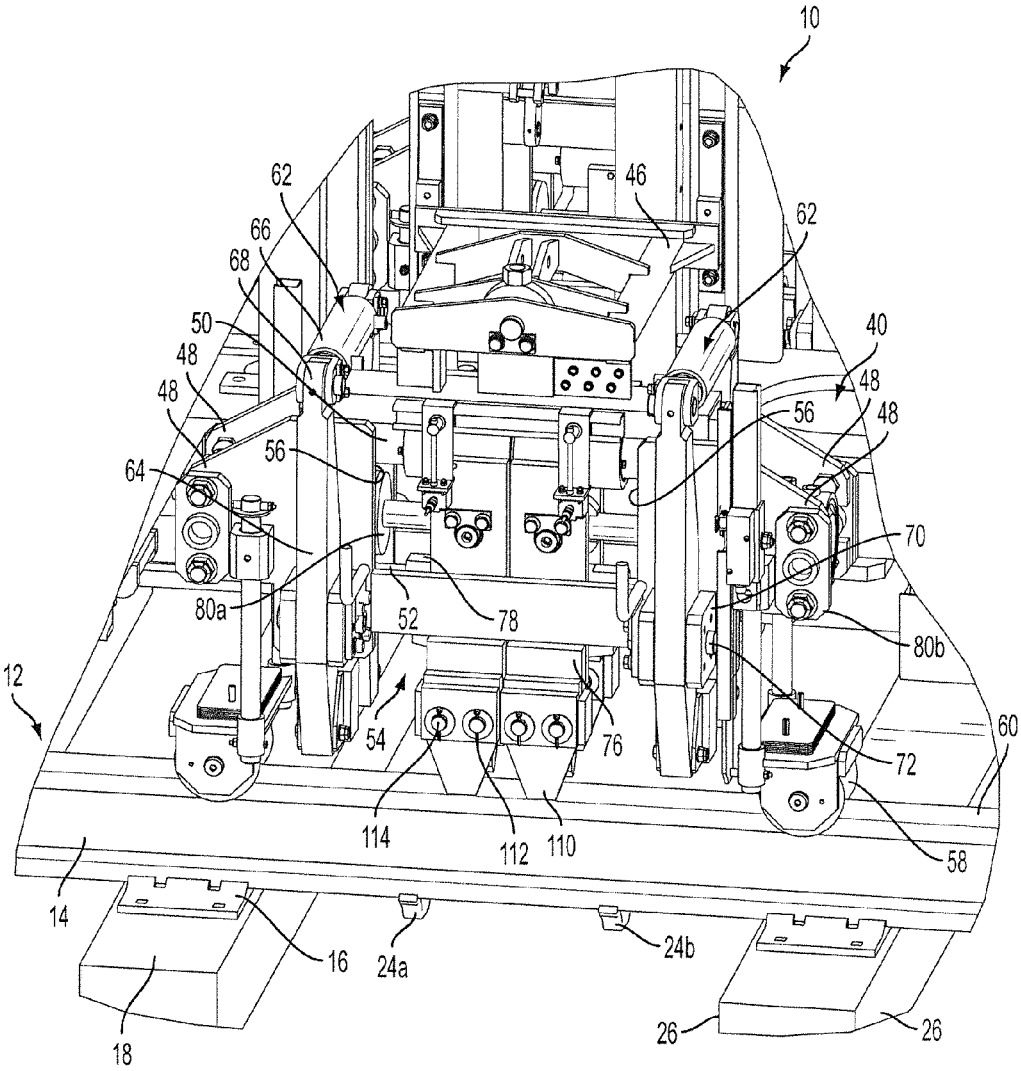
FIG. 11 is a fragmentary top perspective view of the machine of FIG. 1 depicting the work head of FIG. 8 in a ready position after spreading two anchors.
Figure 12:
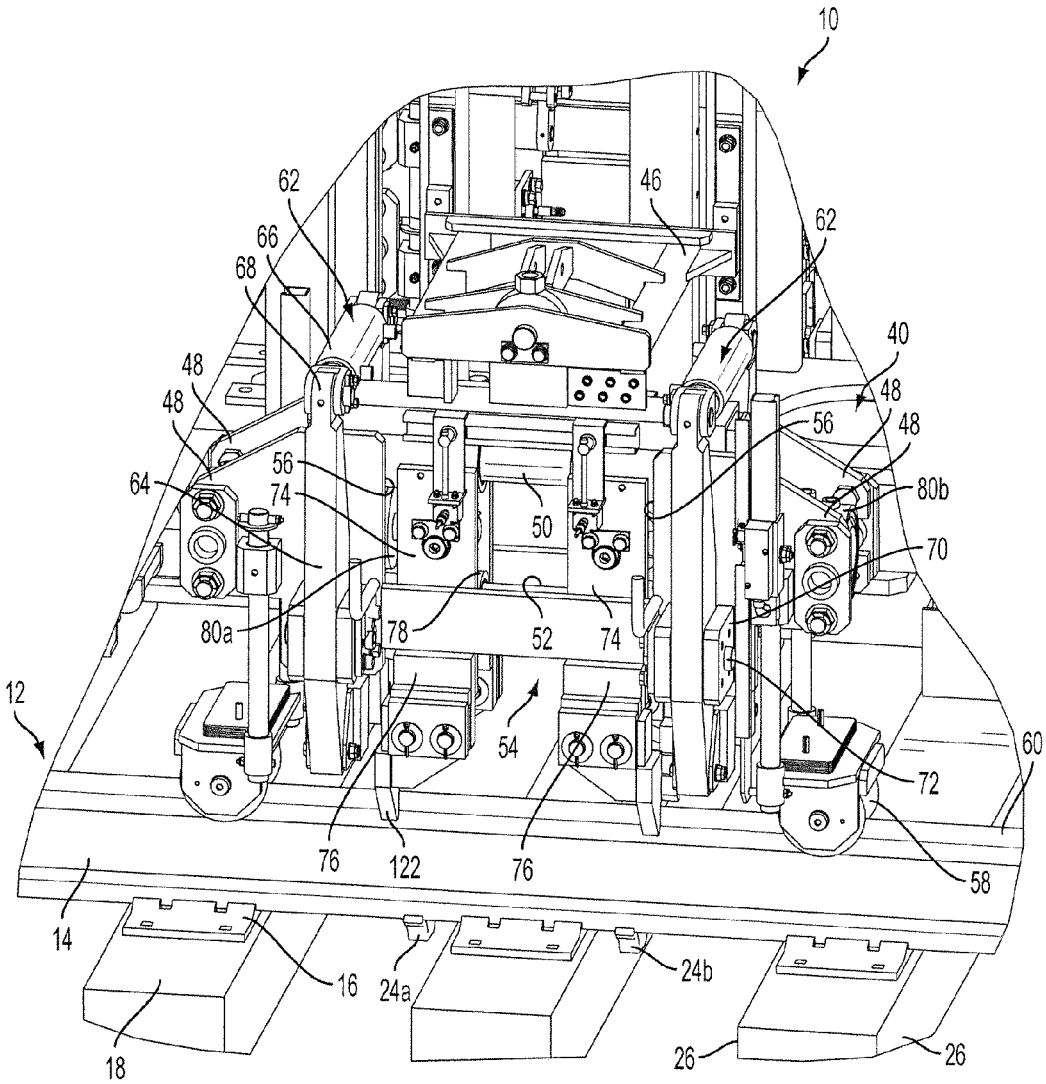
FIG. 12 is a fragmentary top perspective view of the machine of FIG. 1 depicting the work head fitted with tools for directly squeezing two anchors and shown in the ready position.
Figure 22:
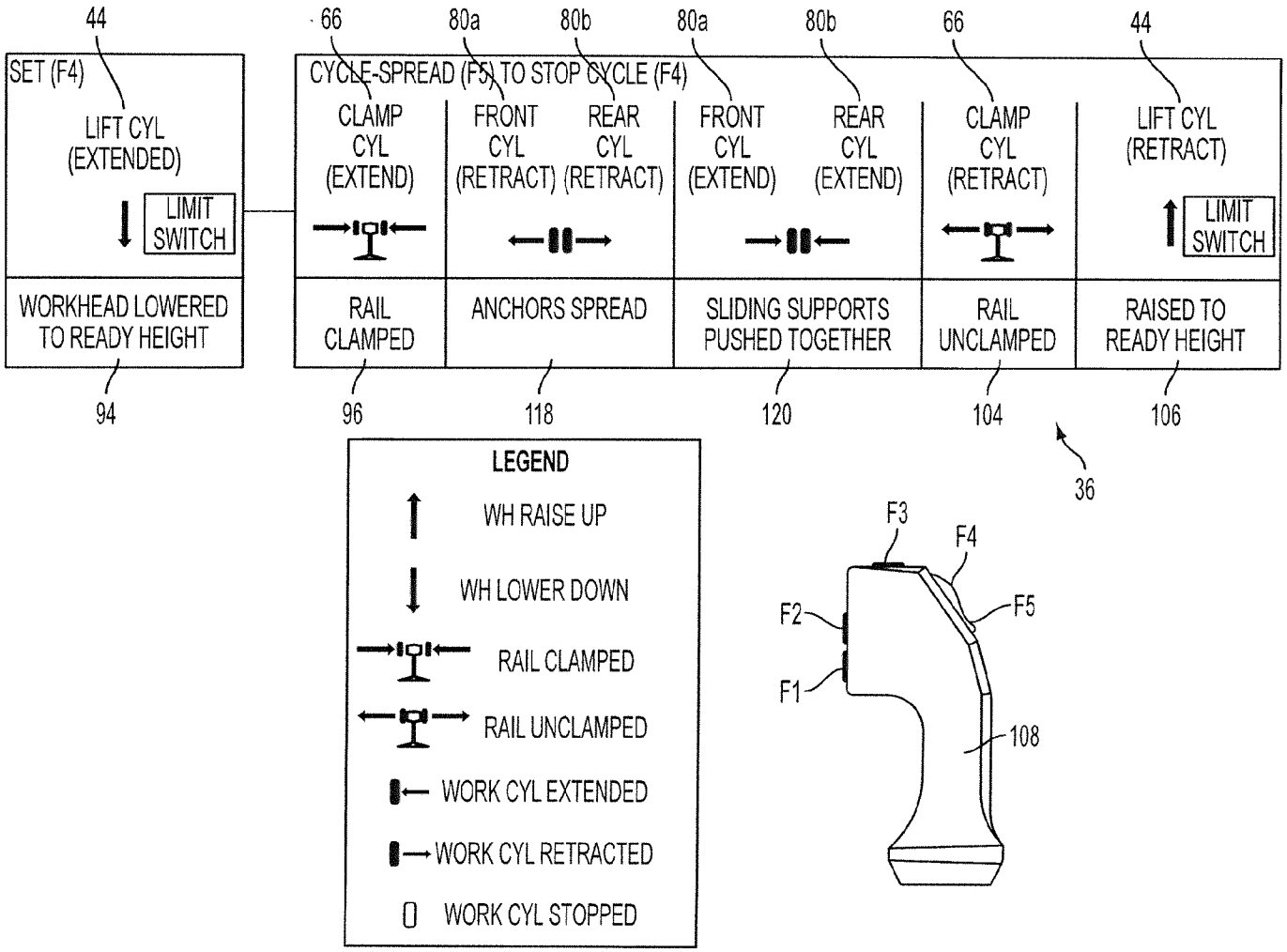
FIG. 22 is a control system flow chart supporting the operation depicted in FIGS. 8-11.

Referring now to FIGS. 9 and 22, upon actuation of button F4 on the control system joystick 108, the lift cylinder 44 lowers the work head 40 to the ready position between the anchors 24*a*, 24*b* as indicated in box 94, and the rail clamp cylinders 66 are activated to clamp the rail 14 as seen in the box 96. Next, referring to FIGS. 10 and box 118 of FIG. 22, both cylinders 80*a* and 80*b* are simultaneously retracted, causing the anchor tools 110 to engage and spread the anchors 24*a*, 24*b*.

The degree of anchor spread, or the retraction of the cylinders 80*a,* 80*b* may vary to suit the situation, and may not always be a full retraction. Furthermore, in some situations it is contemplated that only one of the sliding brackets is employed for spreading only one of the anchors 24*a,* 24*b,* since such spreading is all that is required to clear the tie 18 for removal. As such, the operational cycle is be modified accordingly Referring now to FIGS. 11 and box 120 of FIG. 22, both cylinders 80*a,* 80*b* are extended again to contact each other, and as such are ready to begin another spreading cycle. In conjunction with this step, the rail clamp 62 is released (box 104) and the lift cylinder 44 is retracted (box 106). Since the process is controlled by the control system 36, the cylinder extension of box 120 and the release and retraction of boxes 104 and 106 occur simultaneously to decrease cycle time of the machine 10.

Referring now to FIGS. 12-15 and 23, another embodiment of the present machine 10 is described, this one configured for anchor squeezing. As in the previously described embodiments, reference numbers for shared components and flow chart sequence steps are reapplied. In the anchor squeezing mode, the anchor engaging ends 82 of the work arms 76 are equipped with a specialized anchor squeezing tool 122 described in greater detail below, and mounted to the mounting bores 84 in similar fashion to the anchor tools 86 and 110.

Figure 13:
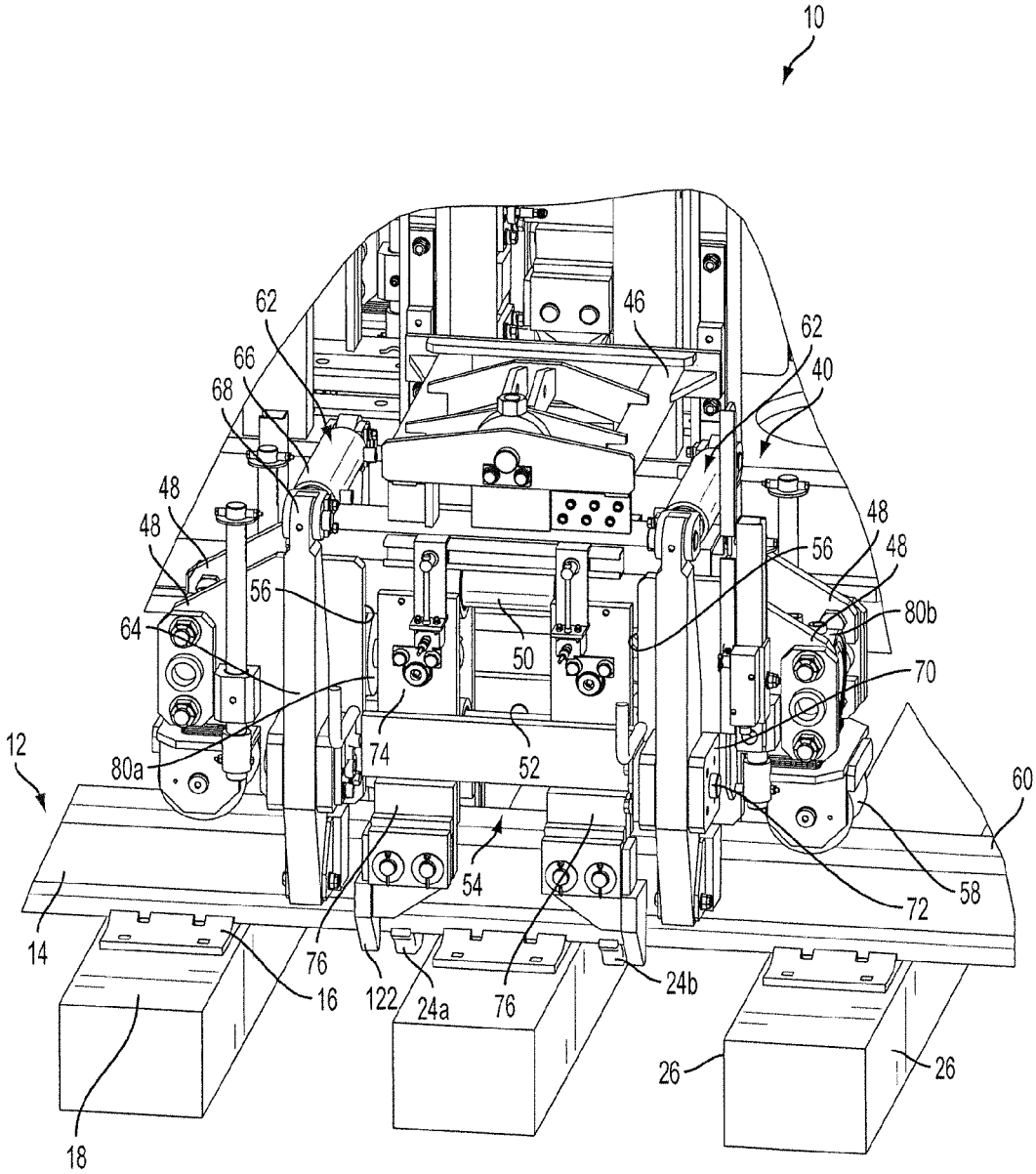
FIG. 13 is a fragmentary top perspective view of the machine of FIG. 1 depicting the work head of FIG. 12 engaging two anchors for squeezing them against a tie.
Figure 23:
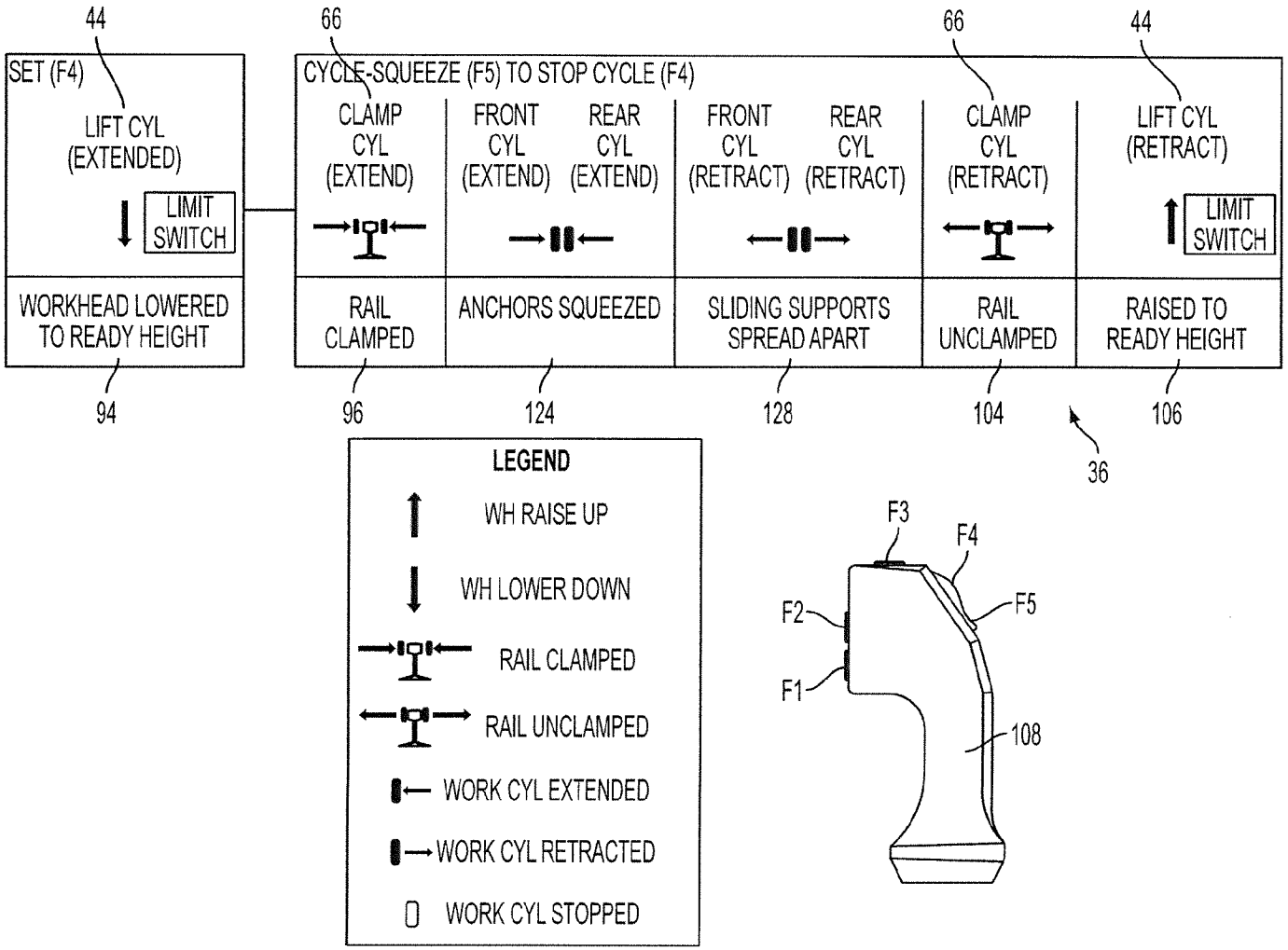
FIG. 23 is a control system flow chart supporting the operation depicted in FIGS. 12-15.

Referring now to FIGS. 13 and 23, the work head 40 is shown in the ready or working position, upon actuation of the button F4 on the joystick 108, having been lowered by the lift cylinder 44 (box 94) and the rail clamp 62 engaged (box 96). In this embodiment, the "start" position of the cylinders 80*a,* 80*b* is retracted so that the sliding brackets 74*a,* 74*b* are spread apart. Thus, as the cycle begins, the anchor spreader tools 122 are located outside, or farther from the tie 18 relative to the anchors 24*a,* 24*b.*

Figure 14:
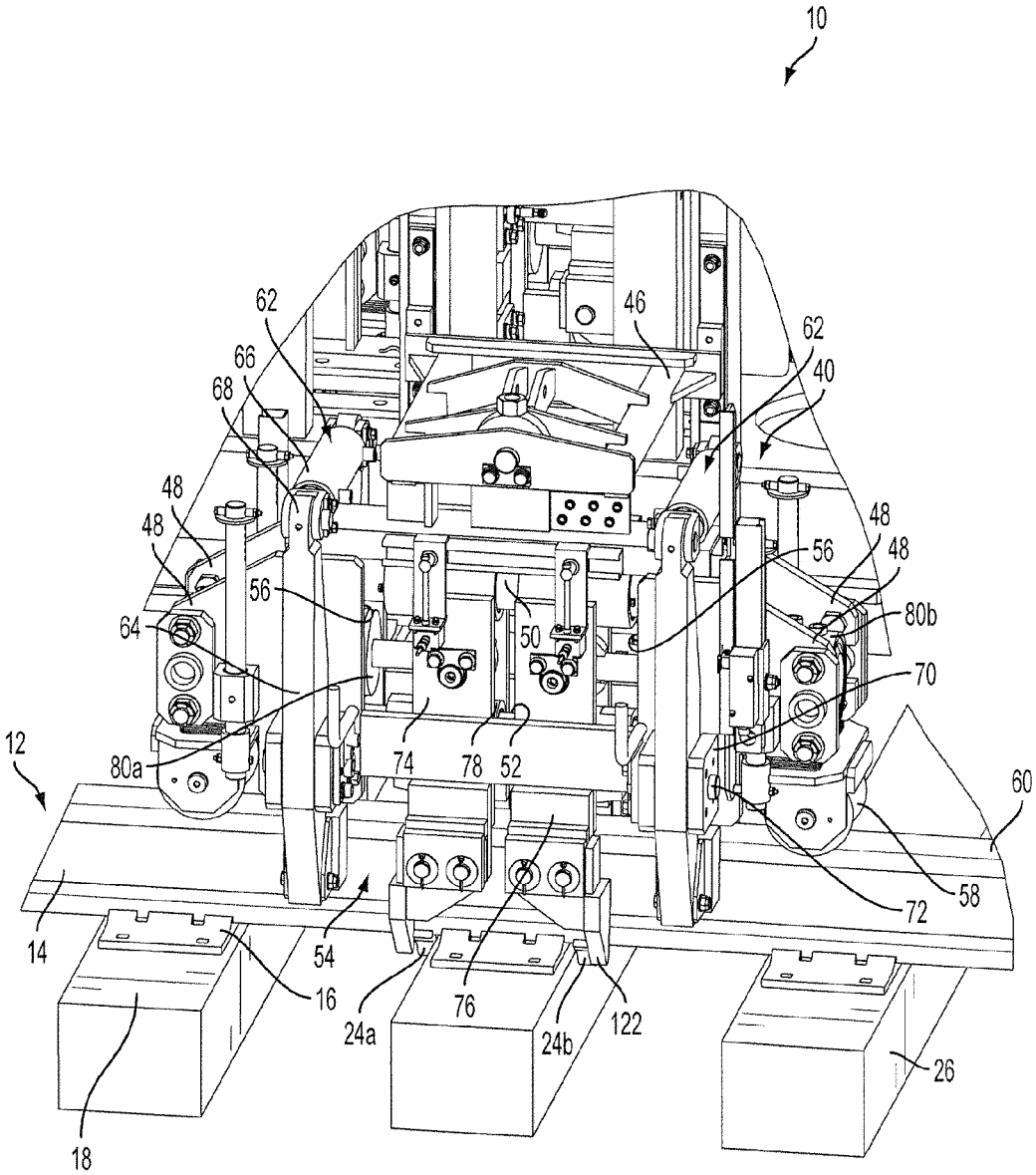
FIG. 14 is a fragmentary top perspective view of the machine of FIG. 1 depicting the work head of FIG. 12 after squeezing the anchors against the tie.
Figure 15:
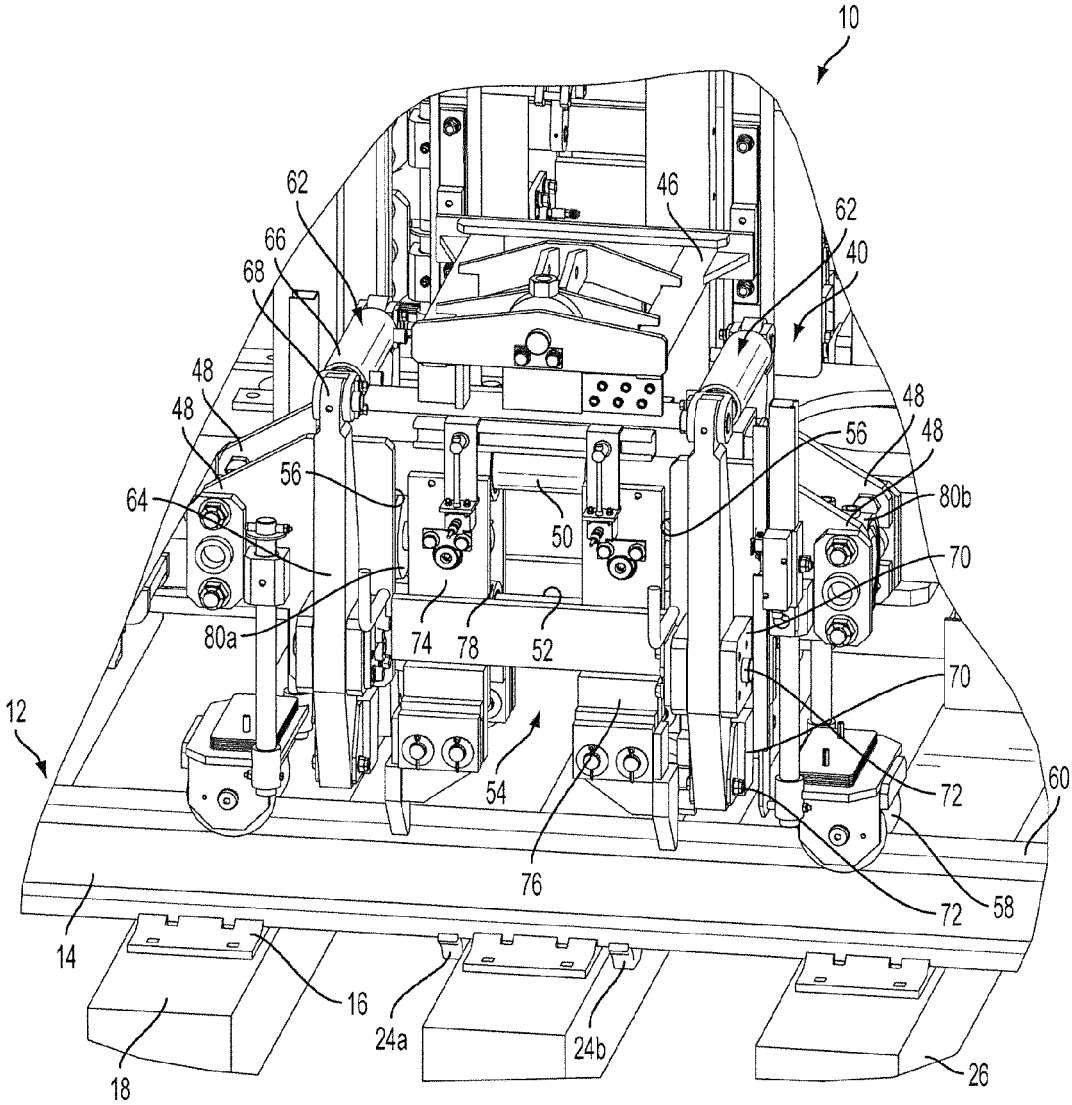
FIG. 15 is a fragmentary top perspective view of the machine of FIG. 1 depicting the work head of FIG. 12 in the ready position after squeezing both anchors.

Referring now to FIG. 14 and box 124 of FIG. 23, both cylinders 80*a,* 80*b* are extended simultaneously, engaging and pushing the anchors 24*a,* 24*b* against the sides 26 of the tie 18. Upon completion of this step, and referring to FIG. 15 and box 128 of FIG. 23, the cylinders 80*a,* 80*b* are retracted, the rail clamp 62 is released (box 104), and the lift cylinder 44 retracted (box 106), all simultaneously to reduced cycle time and to prepare the work head 40 for the next operation.

Figure 16:
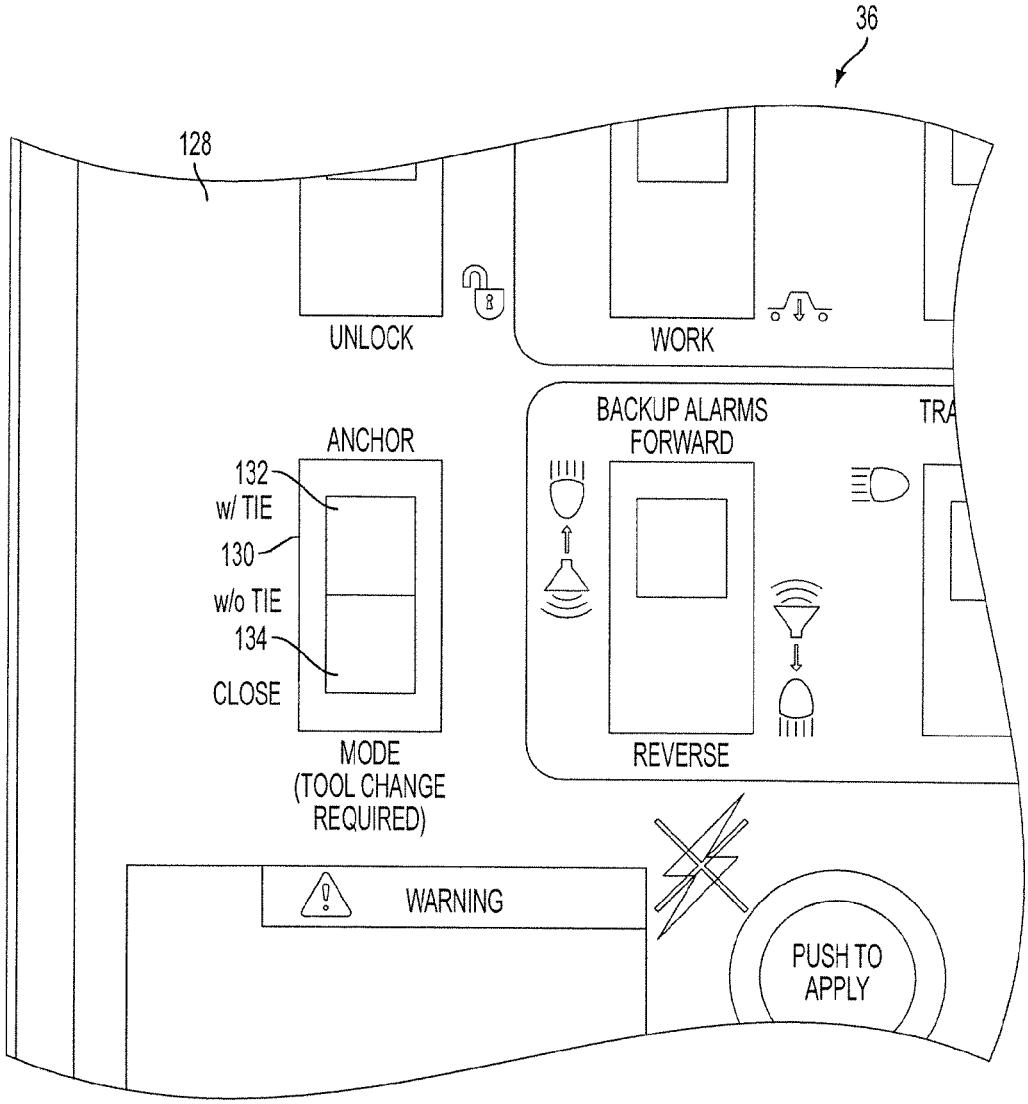
FIG. 16 is a fragmentary front view of the control panel of the machine of FIG. 1.

Referring now to FIG. 16, a portion of the control system 36 is depicted, including a control panel 128 with a spreader mode switch 130. The operator has the option of performing the anchor spreading operation using a rail tie plate 16 as described in relation to FIGS. 2-7, by selecting "w/tie" 132, or using only the anchor tools 110 as described in relation to FIGS. 8-11 by selecting "w/o tie" 134.

Referring now to FIGS. 17-19, the present anchor engaging ends 82 of the work head 40 are provided with at least one type of an interchangeable anchor tool 110 configured for anchor spreading, the squeezing tool 122 and the tie plate clamping tool 86. More specifically, each tool 86, 110, 122 includes a tool body 136 having a mounting end 138 configured for engaging the clevis-like anchor engaging end 82 and having throughbores 140 in registry with the mounting bores 84. Opposite the mounting end 138 is an anchor head or anchor work end 142 with at least one impact surface 144. In the case of the spreader tool 110, there are two such surfaces 144 so that one type of tool is usable on both front and rear sliding brackets 74*a* 74*b.*

In the case of the tools 86 and 122, the anchor head 142 is vertically offset from the mounting end 138 and depends from a side edge 146 of the mounting end. This orientation provides the work head 40 with the required increase in width of operational travel needed for anchor squeezing, and also for grasping the tie plate 16 when the embodiment of FIGS. 2-7 is selected.

Figure 20:
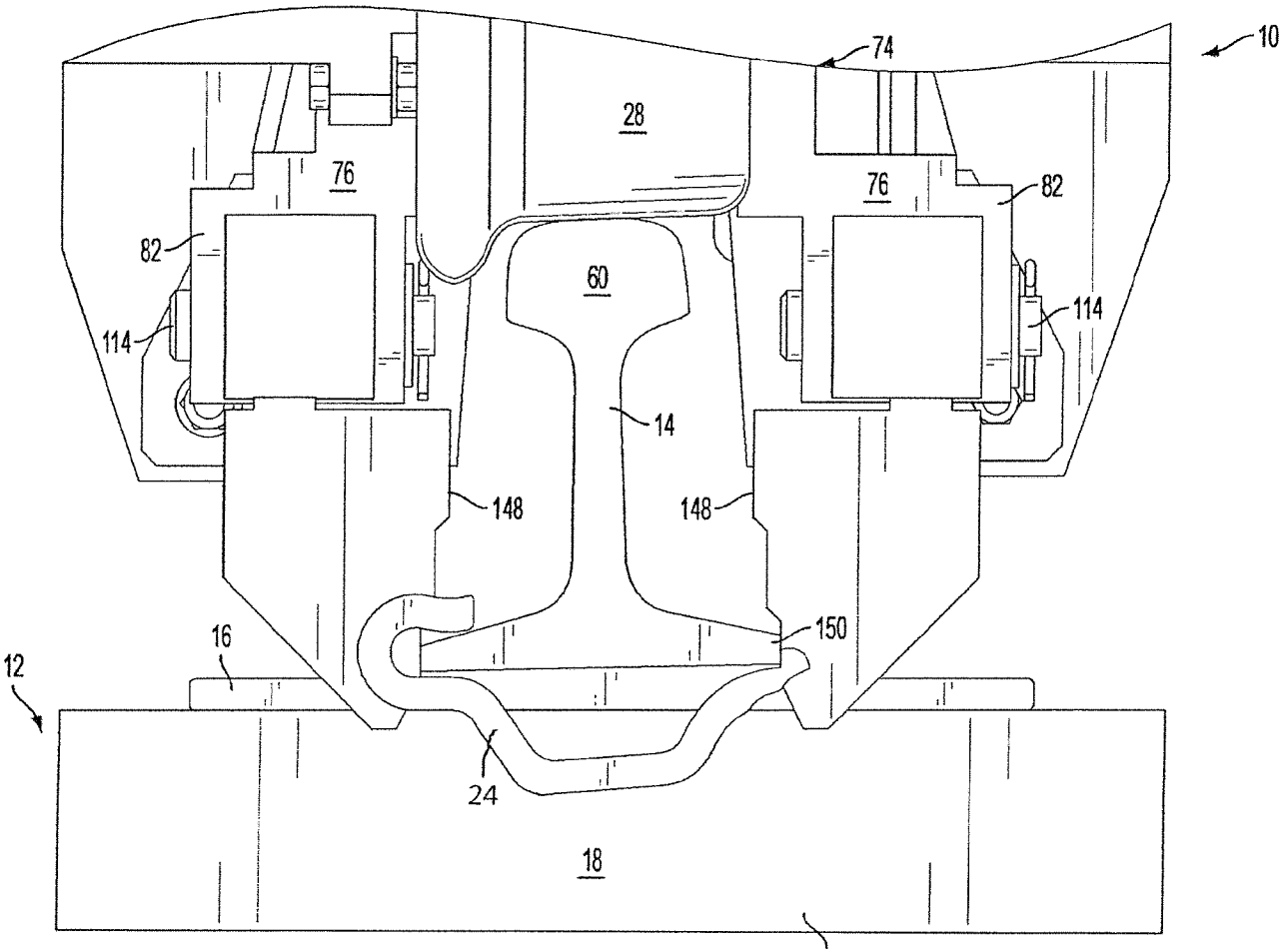
FIG. 20 is a fragmentary front view of the present work head shown with the tool of FIG. 12 engaged on a rail.

Referring now to FIG. 20, the tools 110 and 122 preferably include a rail following surface 148 projecting transversely relative mounting end 138 and the work end 142, and parallel to the rail 14. As depicted, the tool 110 of FIG. 20 corresponds to the tool as depicted in FIG. 8. In addition, the rail following surface 148 is stepped for accommodating variations in the width of a rail base 150. While other configurations are contemplated, the preferred rail following surface 144 has a step pattern accommodating a wider rail base 150 near a bottom of the tool 110, 122, and a narrower base near an upper end of the tool. An advantage of this construction is that one tool 110, 122 is usable on a variety of track configurations, and reduces the inherent downtime of track machinery for changing tools to properly work on different types or brands of rails. Also, in the case of the tools and 122, the stepped rail following surface 148 is on the same portion of the tool as the anchor head 142, found on the side edge 146. In the case of the anchor tool 110, the rail following surface 148 projects from a central portion of the body 136.

While a particular embodiment of the present rail anchor spreader-squeezer has been shown and described, it will be appreciated by those skilled in the art that changes and modifications may be made thereto without departing from the invention in its broader aspects and as set forth in the following claims.

What is claimed:

1. A rail maintenance anchor spreader/squeezer work head for use on a railroad track including a pair of spaced parallel rails extending along a rail axis, comprising:

a work head frame;

a pair of sliding brackets laterally reciprocating on said frame along an operational axis parallel to the rail axis, each said bracket having an anchor engaging end; and a pair of opposed fluid power cylinders secured to said frame, each said cylinder connected to a respective one of said sliding brackets for laterally reciprocating said sliding brackets along said operational axis and relative to said workhead frame and selectively controlled for any one of anchor squeezing, when both cylinders are extended and said brackets move closer together along said operational axis for moving adjacent anchors along the rail to be closer together, and anchor spreading when at least one of said cylinders is retracted and said brackets move apart along said operational axis for spreading the anchors away from each other along the rail.

2. The anchor spreader/squeezer work head of claim 1, wherein said work head is configured for performing an additional function of a tie plate cycle, where one of said cylinders extends so that said respective sliding bracket grasps a tie plate against the other said sliding bracket and uses the plate as a hammer to spread one anchor in a first direction, then said cylinders complementarily extend and retract to move the tie plate to spread the second anchor in an opposite direction, then the other of said cylinders retracts to release the plate.

3. The anchor spreader-squeezer work head of claim 1 wherein each said sliding bracket is provided with an anchor tool at said anchor engaging end.

4. The anchor spreader-squeezer work head of claim 3 wherein said anchor tool is configured for accommodating any one of a plurality of rail width differences without requiring exchange from said sliding bracket.

5. The anchor spreader-squeezer work head of claim 4 wherein said anchor tool has a stepped rail engaging profile.

6. The anchor spreader-squeezer work head of claim 1 wherein each said sliding bracket has a pair of work arms, each of said arms associated with a respective one of a field side and a gage side of the rail.

7. The anchor spreader-squeezer work head of claim 1, wherein when said work head is selected for anchor spreading, said sliding brackets are positioned between a pair of anchors, and said cylinders are simultaneously retracted for spreading the anchors.

8. The anchor spreader-squeezer work head of claim 7, wherein after said cylinders are simultaneously retracted, said work head is configured so that said cylinders are extended as they are raised to a ready position to prepare for the next cycle.

9. The anchor spreader squeezer work head of claim 1, wherein when said work head is selected for anchor spreading, one of said sliding brackets is positioned between said anchors, and said corresponding cylinder is extended for spreading the anchor farthest from said bracket.

10. The anchor spreader-squeezer work head of claim 1 wherein when said work head is selected for anchor squeezing, said pair of sliding brackets are positioned outside and next to a pair of anchors, and said cylinders are simultaneously extended to squeeze the anchors against adjacent sides of a tie.

11. The anchor spreader-squeezer of claim 10, wherein after said cylinders are simultaneously extended, the work head is configured for simultaneously retracting said cylinders as the work head is raised for preparing for the next cycle.

12. The anchor spreader-squeezer of claim 10, where a tool is provided to said anchor engaging end of each said sliding bracket, said tool having an anchor head with an impact surface and a rail following surface transverse to said impact surface and being stepped for accommodating variations in rail base width.

13. The anchor spreader-squeezer work head of claim 1, where each said anchor engaging end is provided with an interchangeably configured spreading tool, a squeezing tool and a tie plate clamping tool.

14. The anchor spreader-squeezer work head of claim 1, wherein said work head frame has an upper guide shaft and a lower guide shaft for guiding said sliding brackets, said cylinders being disposed between and generally parallel to said guide shafts.

15. A rail anchor spreader-squeezer machine configured for selectively squeezing or spreading anchors on a rail of a railroad track, the track extending along a rail axis, said machine comprising:

a machine frame having a front frame end and a rear frame end;

a pair of work heads mounted to a workhead frame connected to said machine frame and being reciprocably movable relative to the track between a working position and a travel position; and a control system connected to said work head, said work head- performing anchor spreading, where at least one of a pair of brackets on said work heads moves farther from the other along an operational axis parallel to the rail axis and relative to said workhead frame, and anchor squeezing, where at least one of said brackets on said work heads moves closer to the other along said operational axis, depending on an operational sequence determined by said control system.

16. The anchor spreader/squeezer machine of claim 15, wherein said work head has a front end and a rear end respectively associated with said frame front and rear ends, said work head being provided with a front fluid power cylinder mounted to said work head front end, and a rear fluid power cylinder mounted to said work head rear end, each of said cylinders connected to a laterally reciprocating sliding bracket moving along said operational axis and having an anchor engaging end.

17. The anchor spreader-squeezer of claim 16, wherein said control system is configured for selectively spreading a pair of anchors by first actuating said cylinders so that they are simultaneously extended along said operational axis, placing said sliding brackets together and said control system positions said brackets between the pair of anchors, then said cylinders simultaneously retract to separate said brackets along said operational axis to spread a pair of the anchors.

18. The anchor spreader-squeezer of claim 16, wherein said control system is configured for causing both cylinders to retract to spread said sliding brackets, which are then lowered so that each is outside a corresponding anchor, then said cylinders are simultaneously extended in a squeezing action for squeezing the anchors against adjacent sides of a rail tie, after which said cylinders are retracted as said work head is raised for the next cycle.

19. The anchor spreader/squeezer of claim 16 wherein said control system is configured for actuating said work head for performing a tie plate cycle, where one of said cylinders extends so that said respective sliding bracket grasps a tie plate against the other said sliding bracket and uses the plate as a hammer to spread one anchor in a first direction, then said cylinders complementarily extend and retract to move the tie to spread the second anchor in an opposite direction, then the other of said cylinders retracts to release the plate.

20. A tool for use with a rail maintenance anchor spreader squeezer having at least one sliding bracket with a work arm having an anchor engaging end, said tool configured for attachment to said anchor engaging end and comprising:

a tool body having a mounting end and an opposite anchor work end, said ends being coplanar, said anchor work end including at least one impact surface; and said tool body being provided with a rail following surface located on a portion of said tool body projecting transversely to a plane defined by said mounting end and to said work end, and said rail following surface extending parallel to a corresponding rail of a railroad track, said following surface being stepped for accommodating variations in rail base width, said stepped surface extending a height of said body and including a plurality of vertically projecting surfaces.

21. The tool of claim 20 wherein said rail following surface is disposed to project normally from a selected one of a central location on said tool body and an edge of said tool body.

* * * * *